US006715861B2

(12) United States Patent
Sakamoto et al.

(10) Patent No.: US 6,715,861 B2
(45) Date of Patent: Apr. 6, 2004

(54) INK JET HEAD AND PRINTING APPARATUS

(75) Inventors: Yoshiaki Sakamoto, Kawasaki (JP); Shuji Koike, Tokyo (JP); Tomohisa Shingai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 5 days.

(21) Appl. No.: 10/164,642

(22) Filed: Jun. 10, 2002

(65) Prior Publication Data

US 2002/0149652 A1 Oct. 17, 2002

Related U.S. Application Data

(63) Continuation of application No. PCT/JP99/06959, filed on Dec. 10, 1999.

(51) Int. Cl.[7] ..... B41J 2/045
(52) U.S. Cl. ..... 347/68
(58) Field of Search ..... 347/68–72

(56) References Cited

FOREIGN PATENT DOCUMENTS

| | | |
|---|---|---|
| JP | 5-8387 | 1/1993 |
| JP | 7-148921 | 6/1995 |
| JP | 7-329293 | 12/1995 |
| JP | 7-329297 | 12/1995 |
| JP | 9-226120 | 9/1997 |
| JP | 11-70649 | 3/1999 |

*Primary Examiner*—Judy Nguyen
(74) *Attorney, Agent, or Firm*—Armstrong, Kratz, Quintos, Hanson & Brooks, LLP

(57) ABSTRACT

A printing apparatus that includes an ink jet head (100) having nozzles for discharging ink supplied thereto from an ink supplying part (50). This printing apparatus includes a head body member (3) having pressure chambers provided individually for the nozzles that are filled with the ink. Further included are pressurization elements provided individually for the pressure chambers for pressurizing the pressure chambers to discharge the ink in the pressure chambers from the nozzles. An ink staying space (130) is provided for temporarily staying the ink from the ink supplying part (50). This ink staying space (130) is formed between the head body member (3) and the ink supplying part (50), and a number of ink supplying paths (129) for communicating the ink staying space (130) and the plurality of pressure chambers is provided.

18 Claims, 29 Drawing Sheets

ADHESION

INK JET HEAD AND PRINTING APPARATUS

This application is a continuation of international application PCT/JP99/06959 filed on Dec. 10, 1999.

TECHNICAL FIELD

This invention relates to an ink jet head having a plurality of nozzles for discharging ink supplied thereto from an ink supplying part, and more particularly to an ink jet head suitable for use, for example, as a printing head of an ink jet printer and a printing apparatus which includes the ink jet head.

BACKGROUND ART

FIGS. 33 and 34 are views illustrating a configuration of a conventional ink jet head (the official gazette of Japanese Patent Laid-Open No. 148921/1995), and wherein FIG. 33 is an exploded perspective view showing a configuration of essential part of the ink jet head and FIG. 34 is a vertical sectional view showing a configuration of essential art of the ink jet head.

As shown in FIGS. 33 and 34, the conventional ink jet head includes a pressure generation unit 320 and a flow path unit 340.

The pressure generation unit 320 includes a communication path substrate 301, a pressure chamber formation substrate 302 and a diaphragm 304 and is formed such that the diaphragm 304 is adhered to one face side (upper side in FIGS. 33 and 34) of the pressure chamber formation substrate 302 and the communication path substrate 301 is adhered to the other face side (lower side in FIGS. 33 and 34) of the pressure chamber formation substrate 302.

A plurality of portions which serve as pressure chambers 303 are formed by punching in the pressure chamber formation substrate 302, and a plurality of communication paths 309 for communicating the pressure chambers 303 of the pressure chamber formation substrate 302 and ink supplying paths 314 formed in an ink supplying path formation substrate 313, which is hereinafter described, with each other are formed by perforation in the communication path substrate 301. Further, a plurality of nozzle communication holes 318*a* are perforated in the communication path substrate 301 in a corresponding relationship to the pressure chambers 303 of the pressure chamber formation substrate 302.

A plurality of pressure elements 306 are disposed on the face (upper side in FIGS. 33 and 34) of the diaphragm 304 opposite to the face adhered to the pressure chamber formation substrate 302 in a corresponding relationship to the pressure chambers 303 of the pressure chamber formation substrate 302 with lower electrodes 305 interposed therebetween. Further, upper electrodes not shown are formed on the opposite side (upper side in FIGS. 33 and 34) of the pressure elements 306 to the lower electrodes 305.

The flow path unit 340 includes a reservoir chamber formation substrate 312, an ink supplying path formation substrate 313, and a nozzle formation substrate 311. The ink supplying path formation substrate 313 is adhered to one face side (upper side in FIGS. 33 and 34) of the reservoir chamber formation substrate 312 and the nozzle formation substrate 311 is adhered to the other face side (lower side in FIGS. 33 and 34) of the reservoir chamber formation substrate 312.

A plurality of nozzles 316 are formed in the nozzle formation substrate 311. A V-shaped ink reservoir chamber

315 is formed by a technique such as punching in the reservoir chamber formation substrate 312, and nozzle communication paths 318*c* are perforated at positions of the reservoir chamber formation substrate 312 corresponding to the nozzles 316 formed in the nozzle formation substrate 311.

A plurality of ink supplying paths 314 for communicating and connecting the ink reservoir chamber 315 and the communication paths 309 of the communication path substrate 301 with and to each other are formed in the ink supplying path formation substrate 313. Further, nozzle communication paths 318*b* are perforated at positions of the ink supplying path formation substrate 313 corresponding to the nozzle communication paths 318*c* formed in the reservoir chamber formation substrate 312. Furthermore, an opening 317 for communicating and connecting an ink tank not shown and the ink reservoir chamber 315 with and to each other is formed in the ink supplying path formation substrate 313.

The pressure generation unit 320 and the flow path unit 340 are adhered to each other by a bonding agent or the like. Consequently, as shown in FIG. 34, the nozzle communication paths 318*a* of the communication path substrate 301, the nozzle communication paths 318*b* of the ink supplying path formation substrate 313 and the nozzle communication paths 318*c* of the reservoir chamber formation substrate 312 are communicated with the nozzles 316 formed in the nozzle formation substrate 311. Further, the pressure chambers 303 and the ink reservoir chamber 315 are communicated with each other through the ink supplying paths 314 and the communication paths 309.

In the configuration described above, ink supplied from the ink tank not shown is supplied into the ink reservoir chamber 315 through the opening 317 and further supplied into the pressure chambers 303 through the ink supplying paths 314 and the communication paths 309.

Then, driving signals are supplied to the upper electrodes (not shown) and the lower electrodes 305 from a driving circuit not shown to deform the pressure elements 306 thereby to displace the diaphragm 304 to raise the ink pressure in the pressure chambers 303 so that drops of the ink are discharged from the nozzles 316 through the nozzle communication holes 318*a* to 318*c* to form an image on a recording medium.

In such a conventional ink jet head as described above, while ink is supplied from the ink tank not shown to the ink reservoir chamber 315 through the opening 317, since the opening 317 must be formed with a greater size as the amount of ink consumed by the ink jet head increases, it is required for the opening 317 to have a greater opening area as the number of nozzles 316 formed in the nozzle formation substrate 311 increases. Consequently, the conventional ink jet head has a subject to be solved that the degree of integration of the ink jet head cannot be raised and, since the ink jet head cannot be miniaturized, a high production cost is required as well.

Meanwhile, in order to improve the print quality of the ink jet printer, it is necessary to make the ink jetting characteristic from the nozzles 316 uniform. In order to make ink jetting from a nozzle 316 on the upstream side and another nozzle 316 on the downstream side along an ink supplying path uniform, stabilized ink supply is required, and it is necessary to lower and make the fluid resistances of the ink supply paths for the individual nozzles to ink uniform.

In the conventional ink jet head described above, in the substrates which form the ink jet head, the ink reservoir chamber 315 for supplying ink supplied thereto from the opening 317 into the pressure chambers 303 is formed, and the pressure chambers 303 are communicated with and connected to the ink reservoir chamber 315 through the ink supplying paths 314 and the communication paths 309.

Generally, in order to miniaturize an ink jet head, it is a common practice to form it with a reduced thickness. However, in order to lower the resistance to ink in the ink reservoir chamber 315, the supplying path length for ink must be reduced and the sectional area must be increased. Accordingly, it is necessary to make the sectional shape of the ink reservoir chamber 315 wide. Consequently, also this gives rise to a subject to be solved in that improvement of the degree of integration and/or miniaturization of the ink jet head are obstructed and a high production cost is required as well.

The present invention has been made in view of such subjects as described above, and it is an object of the present invention to devise the shape and so forth of an ink supplying path to each pressure chamber to make the ink supply to the pressure chambers uniform and make it possible to raise the degree of integration of an ink jet head thereby to miniaturize the ink jet head and hence a printing apparatus.

DISCLOSURE OF THE INVENTION

In order to attain the object described above, according to the present invention, an ink jet head having a plurality of nozzles for discharging ink supplied thereto from an ink supplying part is characterized in that it comprises a head body member including a plurality of pressure chambers provided individually for the nozzles for being filled with the ink and a plurality of pressurization elements provided individually for the pressure chambers for pressurizing the pressure chambers to discharge the ink in the pressure chambers from the nozzles, that an ink staying space for temporarily staying the ink from the ink supplying part therein is formed between the head body member and the ink supplying part, and that a plurality of ink supplying paths for communicating the ink staying space and the plurality of pressure chambers individually with each other are formed in the head body member such that one end side of each of the ink supplying paths is open to the ink staying space on an outer face of the head body member and the other end side of each of the ink supplying paths is open to a corresponding one of the pressure chambers.

Further, according to the present invention, a printing apparatus which includes an ink jet head having a plurality of nozzles for discharging ink supplied thereto from an ink supplying part is characterized in that the ink jet head comprises a head body member including a plurality of pressure chambers provided individually for the nozzles for being filled with the ink and a plurality of pressurization elements provided individually for the pressure chambers for pressurizing the pressure chambers to discharge the ink in the pressure chambers from the nozzles, that an ink staying space for temporarily staying the ink from the ink supplying part therein is formed between the head body member and the ink supplying part, and that a plurality of ink supplying paths for communicating the ink staying space and the plurality of pressure chambers individually with each other are formed in the head body member such that one end side of each of the ink supplying paths is open to the ink staying space on an outer face of the head body member and the other end side of each of the ink supplying paths is open to a corresponding one of the pressure chambers.

With the ink jet head and the printing apparatus of the present invention, since the ink staying space and the pressure chambers are communicated with each other individually by the ink supplying paths, ink from the ink supplying part can be supplied directly into the pressure chambers, and there is no necessity to provide ink supplying ports for exclusive use in the head body member. Therefore, there is an advantage that the degree of integration of the ink jet head can be improved and the ink jet head and hence the printing apparatus can be miniaturized, which contributes also to reduction of the production cost. Further, there is an advantage that supply of ink to the pressure chambers can be made uniform, and the printing quality can be improved.

A framework member may be provided in a projecting manner on the head body member in such a manner as to surround openings of the plurality of ink supplying paths on the outer face of the head body member, and the ink staying space may be formed by the framework member, head body member and ink supplying part. With the configuration, there is an advantage that the rigidity of the head body member can be raised and the ink staying space can be formed readily.

The head body member may be formed on a substrate, and the framework member may be formed as a remaining portion of the substrate on the head body member by partly removing the substrate from the head body member. With the configuration, there is an advantage that, since the framework member can be formed readily and with certainty in a process of formation of the substrate, the production cost can be reduced.

The framework member may be used as a joining element for joining the ink supplying part to the head body member. With the configuration, the ink supplying part can be joined readily and with certainty to the head body member. Further, also where the ink supplying part is adhered to the head body member using a bonding agent or the like, since there is no possibility that protruding bonding agent or the like may stick to a pressurization element or the like of the head body member, there is no necessity to form an adhesive width on the head body member. Consequently, there is an advantage that the degree of integration of the ink jet head can be raised.

Each of the pressurization elements may include a diaphragm which forms one face of a corresponding one of the pressure chambers and partitions the pressure chamber and the ink staying space from each other, and a piezoelectric element formed by lamination on the diaphragm on the outside of the pressure chamber for driving the diaphragm to pressurize the pressure chamber. With the configuration, there is an advantage that the pressurization elements can be formed with certainty and the readiness of production of the ink jet head can be improved.

Each of the ink supplying paths may extend through the diaphragm in a region other than a region in which a corresponding one of the piezoelectric elements is laminated. With the configuration, since the ink is prevented from contacting with the piezoelectric elements, there is an advantage that there is no possibility that the piezoelectric elements may be influenced by the ink.

Alternatively, each of the ink supplying paths may extend through the diaphragm in a region in which a corresponding one of the piezoelectric elements is laminated. With the configuration, since there is no necessity to provide a space for exclusive use for openings of the ink supplying paths, there is an advantage that the degree of integration of the ink jet head can be further improved and the ink jet head and hence the printing apparatus can be further miniaturized, which contributes to further reduction of the production cost.

Further alternatively, each of the ink supplying paths maybe formed so as to open on a face of a corresponding one of the pressure chambers other than the face formed by the diaphragm, or each of the ink supplying paths may be formed so as to open on a face of a corresponding one of the pressure chambers opposing to the face formed by the diaphragm. With the configuration, since the pressurizing elements of the pressure chambers are not influenced by the openings at all, there is an advantage that the rigidity of the pressure chambers can be maintained and besides the pressurization operation of the pressure chambers is stabilized.

BRIEF DESCRIPTION OF THE DRAWINGS

FIG. 9 is a sectional view taken along line B—B of

FIG. 13(*b*) is a perspective view showing a configuration of a head body member of the ink jet head as the first modification to the first embodiment of the present invention;

FIG. 28(*b*) is a sectional view taken along line A—A of FIG. 28(*a*);

FIG. 29(*b*) is a sectional view taken along line A—A of FIG. 29(*a*);

FIG. 30(*b*) is a sectional view taken along line A—A of FIG. 30(*a*);

BEST MODE FOR CARRYING OUT THE INVENTION (A) Description of the First Embodiment In the following, embodiments of the present invention are described with reference to the drawings.

Figure 1:
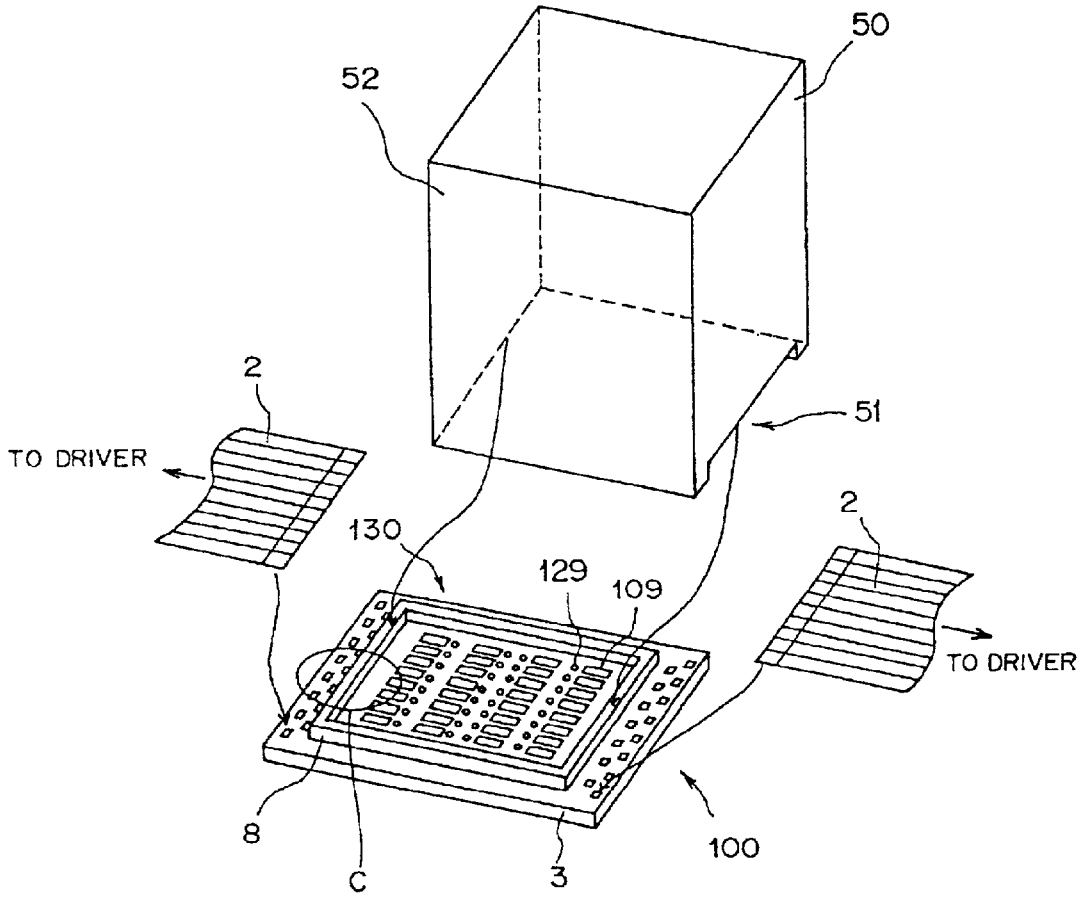
FIG. 1 is an exploded perspective view showing a general configuration of an ink jet head as a first embodiment of the present invention.
Figure 2:
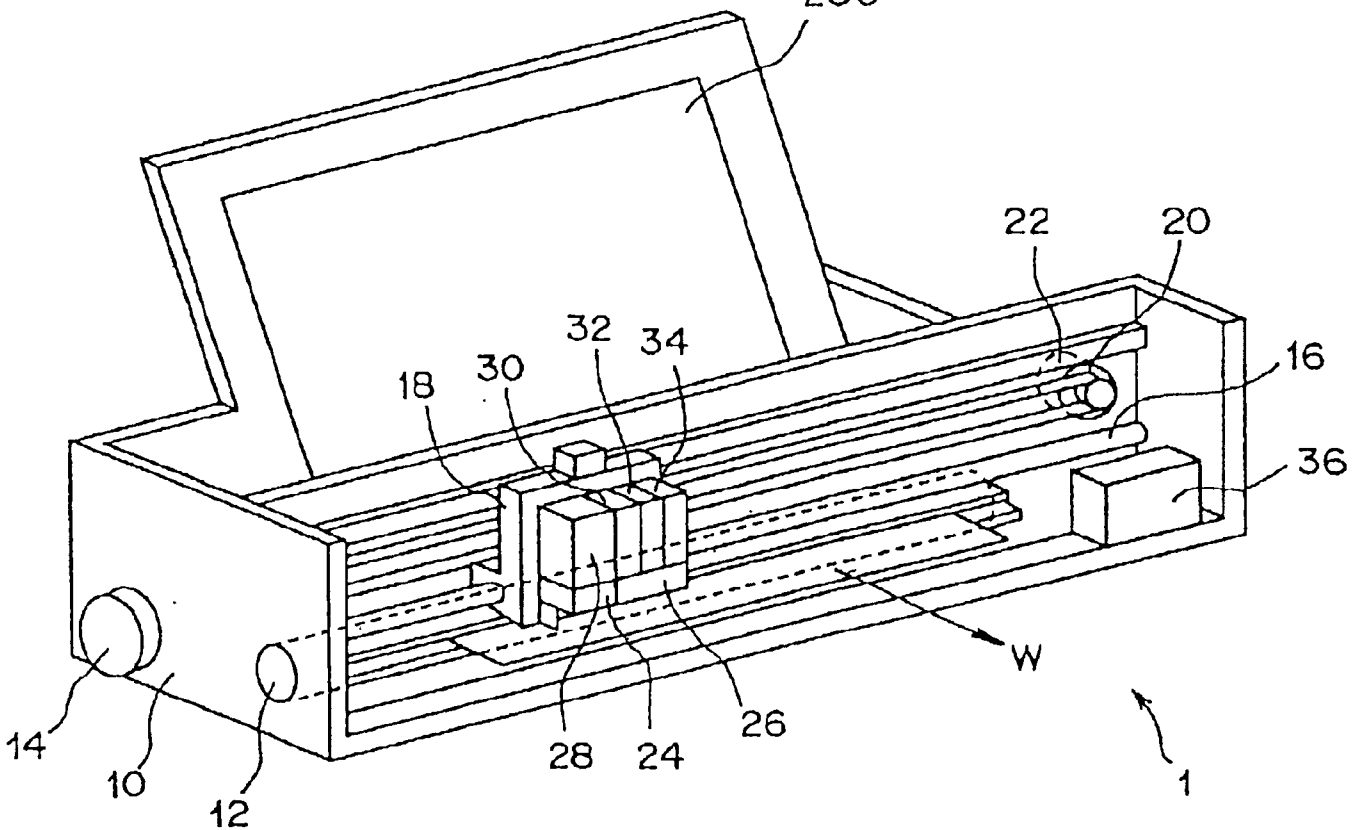
FIG. 2 is a perspective view showing a configuration of an ink jet printer which includes the present ink jet head.

FIG. 1 is an exploded perspective view showing a general configuration of an ink jet head as a first embodiment of the present invention, and FIG. 2 is a perspective view showing a configuration of an ink jet printer which includes the ink jet head of the first embodiment of the present invention.

An ink jet printer 1 is a printing apparatus wherein ink is discharged to printing paper 200 to form an image on the surface of the printing paper 200, and includes a platen 12, a carriage 18, a nozzle maintenance mechanism 36, ink jet head units 24 and 26, and ink tanks 28, 30, 32 and 34 provided in a housing 10.

The platen 12 is mounted for rotation on the housing 10 such that it extends in a direction perpendicular to a transporting direction of the printing paper 200 in the present ink jet printer 1. Further, the platen 12 is driven to rotate intermittently by a drive motor 14. Consequently, the printing paper 200 is transported intermittently in the direction of an arrow mark W in FIG. 2 in a predetermined feed pitch.

A guide rod 16 is disposed in parallel to the platen 12 above the platen 12 in the housing 10, and the carriage 18 is mounted for sliding movement on the guide rod 16.

The carriage 18 is attached to an endless drive belt 20 disposed in parallel to the guide rod 16. The endless drive belt 20 is driven by a drive motor 22 so that the carriage 18 is moved back and forth along the platen 12. The ink jet head units 24 and 26 are removably mounted on the carriage 18.

The ink jet head units 24 and 26 have the ink tanks 28, 30, 32 and 34 joined to the ink jet head 100, respectively. Here, the ink tank 28 in which black ink is contained is attached to the ink jet head unit 24, and the ink tank 30 in which yellow ink is contained, the ink tank 32 in which magenta ink is contained and the ink tank 34 in which cyan ink is contained are attached to the ink jet head unit 26.

While the carriage 18 is moved back and forth along the platen 12, the ink jet head units 24 and 26 are driven based on image data obtained from a high order apparatus such as a personal computer not shown so that predetermined characters, images and so forth are formed on the printing paper 200 to perform printing.

When the printing stops, the carriage 18 (ink jet head units 24 and 26) is moved to a position (home position) at which the nozzle maintenance mechanism 36 is disposed.

The nozzle maintenance mechanism 36 includes a movable suction cap (not shown) and a suction pump (not shown) connected to the movable suction cap. When the ink jet head units 24 and 26 are moved to the home position, the suction cap is attracted to nozzle plates (hereinafter described) of the ink jet head units 24 and 26 and the suction pump is driven so that nozzles of the nozzle plates are attracted to prevent otherwise possible choking of the nozzles.

Now, a configuration of the ink jet head 100 as the first embodiment of the present invention is described with reference to FIGS. 1 and 3 to 6.

Figure 3:
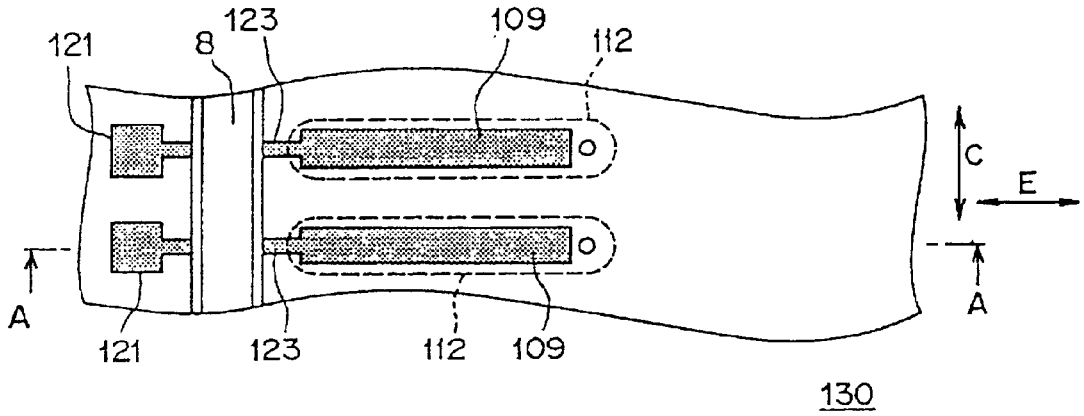
FIG. 3 is a plan view showing a C portion of FIG. 1 in an enlarged scale.
Figure 4:
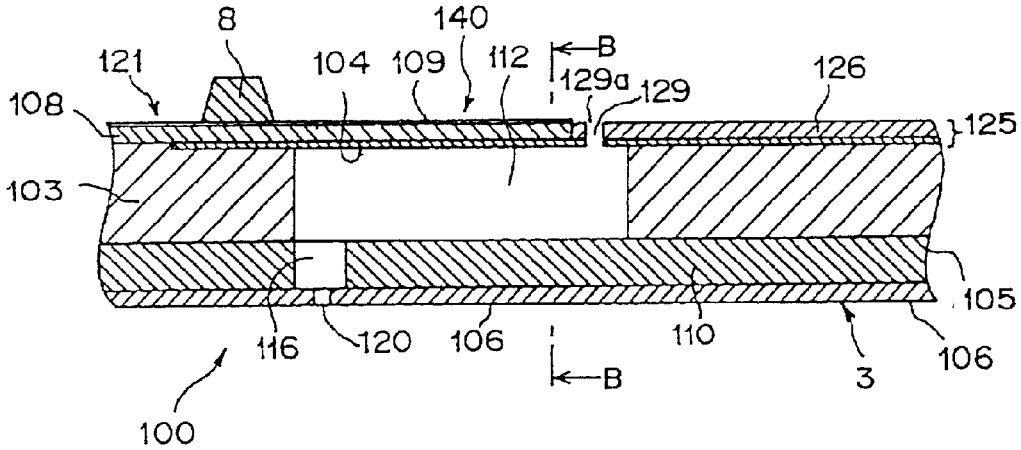
FIG. 4 is a sectional view taken along line A—A of FIG. 3.
Figure 5:
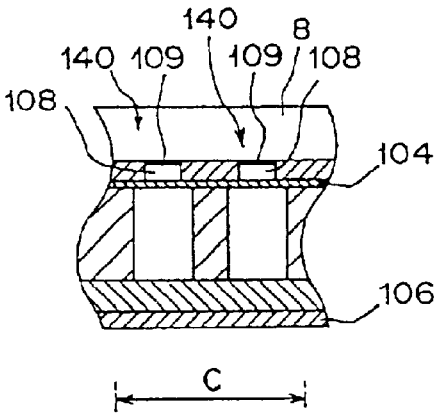
FIG. 5 is a sectional view taken along line B—B of FIG. 4.
Figure 6:
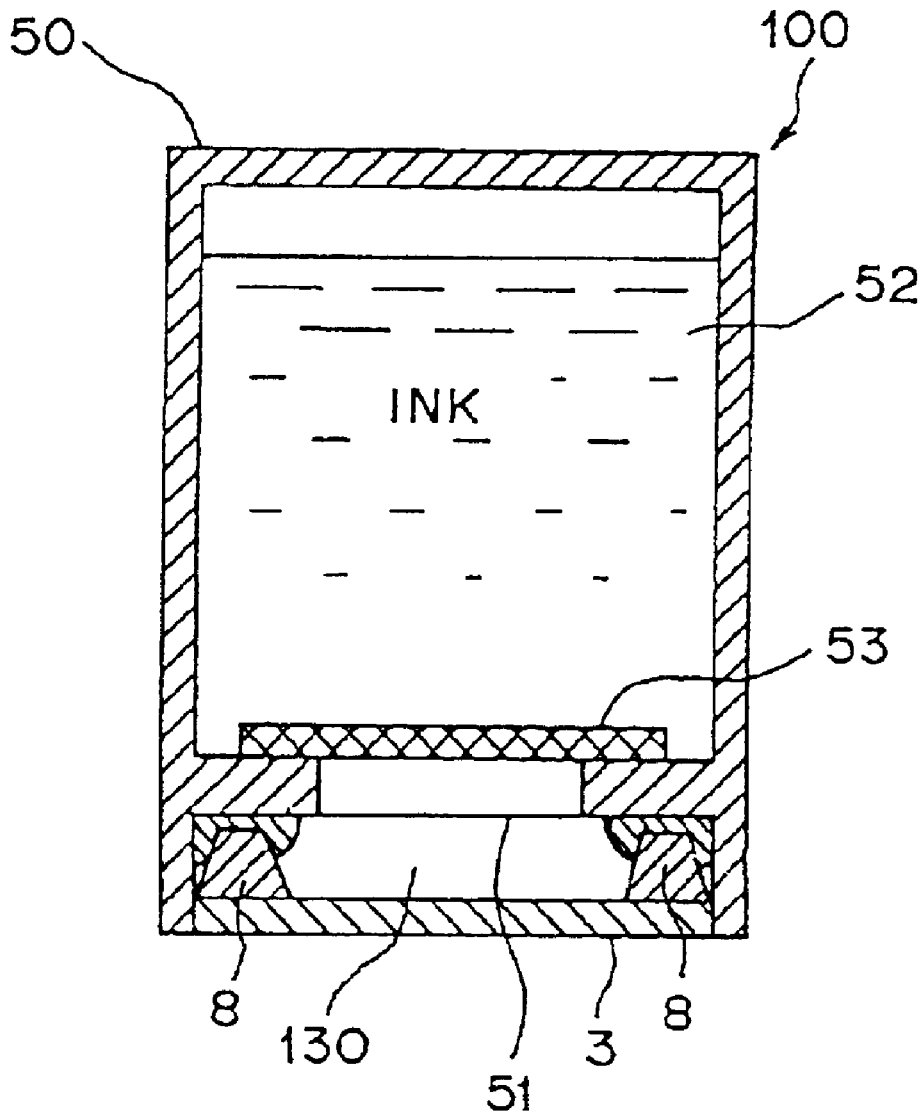
FIG. 6 is a vertical sectional view of the ink jet head as the first embodiment of the present invention to which an ink tank is joined.

FIG. 3 is a view showing a C portion of FIG. 1 in an enlarged scale, FIG. 4 is a sectional view taken along line A—A of FIG. 3, FIG. 5 is a sectional view taken along line B—B of FIG. 4, and FIG. 6 is a vertical sectional view of the ink jet head as the first embodiment of the present invention to which an ink tank is joined.

The ink jet head 100 of the present first embodiment has a plurality of nozzles 120 (refer to FIG. 4) for discharging ink supplied thereto from an ink tank (ink supplying section) 50 and includes a head body member 3 and a framework member (joining element) 8 as shown in FIG. 1.

The head body member 3 includes a pressure chamber 112 and a pressurization element 140 for each of the plurality of nozzles 120 in the inside thereof as shown in FIGS. 3 to 5.

It is to be noted that the head body member 3 of the ink jet head 100 of the present first embodiment is formed by laminating a plurality of layers such as, as shown in FIG. 4, a dry film resist layer 103, a diaphragm 104, a stainless steel plate 105, a polyimide layer 126, individual electrodes 109 and a nozzle plate 106. The process of production by lamination is hereinafter described.

The pressure chamber 112 is used to fill ink and is communicated with and connected to the nozzle 120 through a communication path 116.

The pressurization element 140 is used to pressurize the pressure chamber 112 to discharge the ink in the pressure chambers 112 from the nozzles 120 and is formed from the diaphragm 104 and a piezoelectric element 108.

The diaphragm 104 is formed from a flexibly deformable thin metal film (of a thickness of approximately several $\mu$m) having electric conductivity and having some rigidity such as chrome or nickel. The diaphragm 104 forms part of the pressure chamber 112, more particularly a face of the pressure chamber 112 which opposes to a face in which the communication path 116 is formed.

A piezoelectric element 108 in the form of a thin film is formed on a face of the diaphragm 104 opposite to the pressure chamber 112. The piezoelectric element 108 is formed from a piezoelectric ceramic material or the like, and a bimorph laminate is formed from the diaphragm 104 and the piezoelectric element 108.

An individual electrode 109 is formed on a face of the piezoelectric element 108 opposite to the diaphragm 104. When a driving signal is supplied from a drive circuit not shown to the diaphragm 104 and the individual electrode 109, the piezoelectric element 108 is deformed at the pressurization element 140 to pressurize the pressure chamber 112. In other words, an individual electrode 109 for driving a pressurization element 140 is provided for each of the pressure chambers 112.

In the ink jet head 100 of the first embodiment, an ink supplying path 129 is formed in a face of each of the pressure chambers 112 opposing to the face in which the communication path 116 is formed, that is, in the face of each of the pressure chambers 112 formed by the diaphragm 104 such that it extends through the diaphragm 104 (that is, the polyimide layer 126) in a region other than the lamination region of the piezoelectric element 108. In other words, the ink supplying path 129 is open on one end side thereof to the corresponding pressure chamber 112 and is open on the other end side thereof to an ink staying space 130 (hereinafter described with reference to FIG. 6) on the outer face of the head body member 3. In the following description, the opening of the ink supplying path 129 in the ink staying space 130 is represented by reference character 129*a*.

It is to be noted that the number of ink supplying paths 129 for each of the pressure chambers 112 is not limited to 1 but can be modified in various forms without departing from the spirit and scope of the present invention.

The ink supplying path 129 has fluid resistance to ink adjusted so as to absorb a sudden variation of the internal pressure of the pressure chamber 112. Further, a necessary amount of ink is supplied into the pressure chamber 112 through the ink supplying path 129 upon returning after the pressure chamber 112 is contracted to pressurize and discharge ink therefrom. It is to be noted that such supply of ink is performed based on the adjustment of the fluid resistance to the ink.

The ink tank 50 is an ink supplying part for supplying ink to the nozzles 120 of the head body member 3 while keeping a suitable negative pressure and includes an ink chamber 52, a filter 53 and an ink supply port 51 as shown in FIG. 6.

The ink chamber 52 is a space for retaining ink therein. For example, sponge is filled in the ink chamber 52 so that a suitable negative pressure is maintained in the ink chamber 52.

The ink supply port 51 is formed at a lower portion of the ink tank 50 such that the ink retained in the ink chamber 52 is supplied from the ink supply port 51 to the head body member 3 side. The filter 53 is disposed between the ink chamber 52 and the ink supply port 51.

The ink tank 50 is adhered to a framework member 8 (hereinafter described) of the head body member 3 using a bonding agent or the like such that the head body member 3, framework member 8 and ink tank 50 cooperatively define the ink staying space 130 for allowing ink from the ink tank 50 to temporarily reside therein.

The pressure chambers 112 and the ink staying space 130 are communicated with and connected to each other through the ink supplying paths 129. Each of the ink supplying paths 129 is open at one end thereof to the ink staying space 130 on the outer face of the head body member 3.

It is to be noted that the pressure chambers 112 are disposed such that they are aligned with each other in the direction of an arrow mark C in FIGS. 3 and 5.

The framework member (joining element) 8 is formed in a projecting fashion on the face of the head body member 3 on the opposite side (the side on which the individual electrodes 109 of the head body member 3 are formed) to the side on which the nozzles 120 are formed such that it surrounds the openings 129*a* of the plurality of ink supplying paths 129 and the individual electrodes 109 on the outer face of the head body member 3 on which the openings 129*a* of the ink supplying paths 129 are formed.

In particular, the framework member 8 is formed on the face on which the individual electrodes 109, contact elements (hereinafter described) and wiring line patterns (hereinafter described) are formed such that it surrounds the openings 129*a* of the ink supplying paths 129 and the individual electrodes 109.

The framework member 8 is formed as a remaining portion of a substrate made of magnesium oxide (MgO) on the head body member 3 by partly removing the substrate from the head body member 3 by a photo-etching process as hereinafter described. Then, the ink tank (ink supplying part) 50 is joined to the framework member 8 using a bonding agent or the like to join the ink tank 50 (ink tank securing member) to the head body member 3 as shown in FIG. 6.

It is to be noted that the element to be joined to the framework member 8 is not limited to such an ink tank 50 as described above, but may be, for example, a member (ink tank securing member; not shown) on which the ink tank 50 can be removably mounted.

The framework member 8 has such a sectional shape that the width thereof decreases upwardly as shown in FIGS. 4 and 6 so that bonding agent protruding from the adhering faces thereof to the ink tank 50 or the like may be retained by the inclined faces thereby to prevent the protruding bonding agent from reaching the head body member 3.

When the ink tank 50 is joined to the framework member 8, the ink staying space 130 for allowing ink from the ink tank 50 to temporarily reside therein is formed between the ink tank 50 and the head body member 3 as shown in FIG. 6. More particularly, the space defined by the ink supply port 51 of the ink tank 50, the head body member 3 and the framework member 8 functions as the ink staying space 130.

A plurality of contact elements 121 are formed in the proximity of an outer edge of the head body member 3, or more particularly, on the outer side with respect to the framework member 8, on the face of the head body member 3 on which the individual electrodes 109 and the openings 129*a* are formed.

The contact elements 121 are formed individually for the individual electrodes 109. The contact elements 121 and the individual electrodes 109 are individually electrically connected to each other by wiring line patterns 123 formed as a thin film.

The contact elements 121 are electrically connected to an FPC (Flexible Printed Circuit Board; external connection wiring line member) 2 for supplying signals for controlling the pressurization elements 140 in accordance with a TAB (Tape Automated Bonding) system.

It is to be noted that the polyimide layer 126 is disposed for electric insulation in a region of the diaphragm 104 in which none of the piezoelectric element 108 and the individual electrode 109 is present.

Now, a shape of the wiring line patterns 123 for electrically connecting the individual electrodes 109 and the corresponding contact elements 121 is described with reference to FIGS. 7 to 9.

Figure 7:
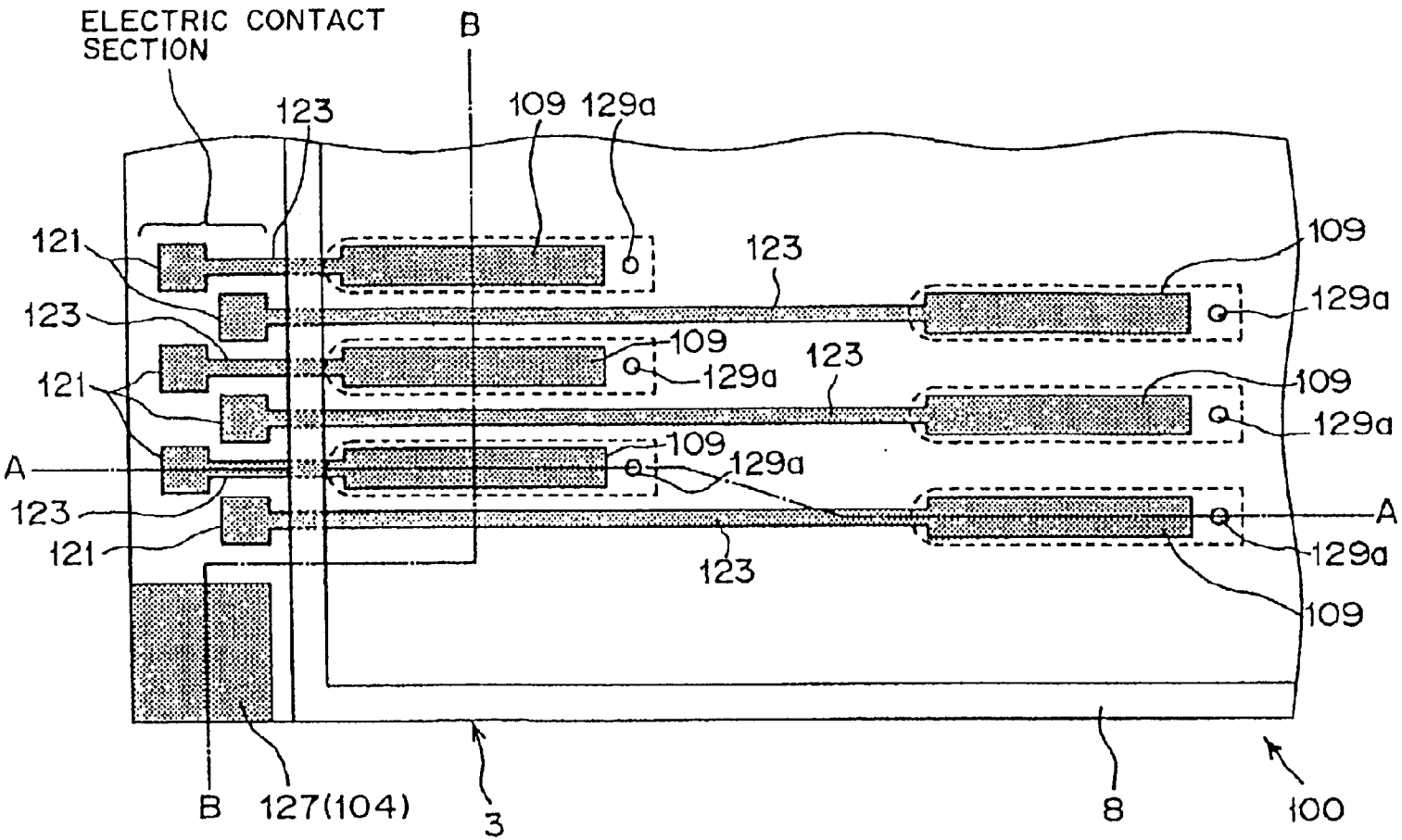
FIG. 7 is a plan view showing essential part of wiring patterns of the ink jet head as the first embodiment of the present invention in an enlarged scale.
Figure 8:
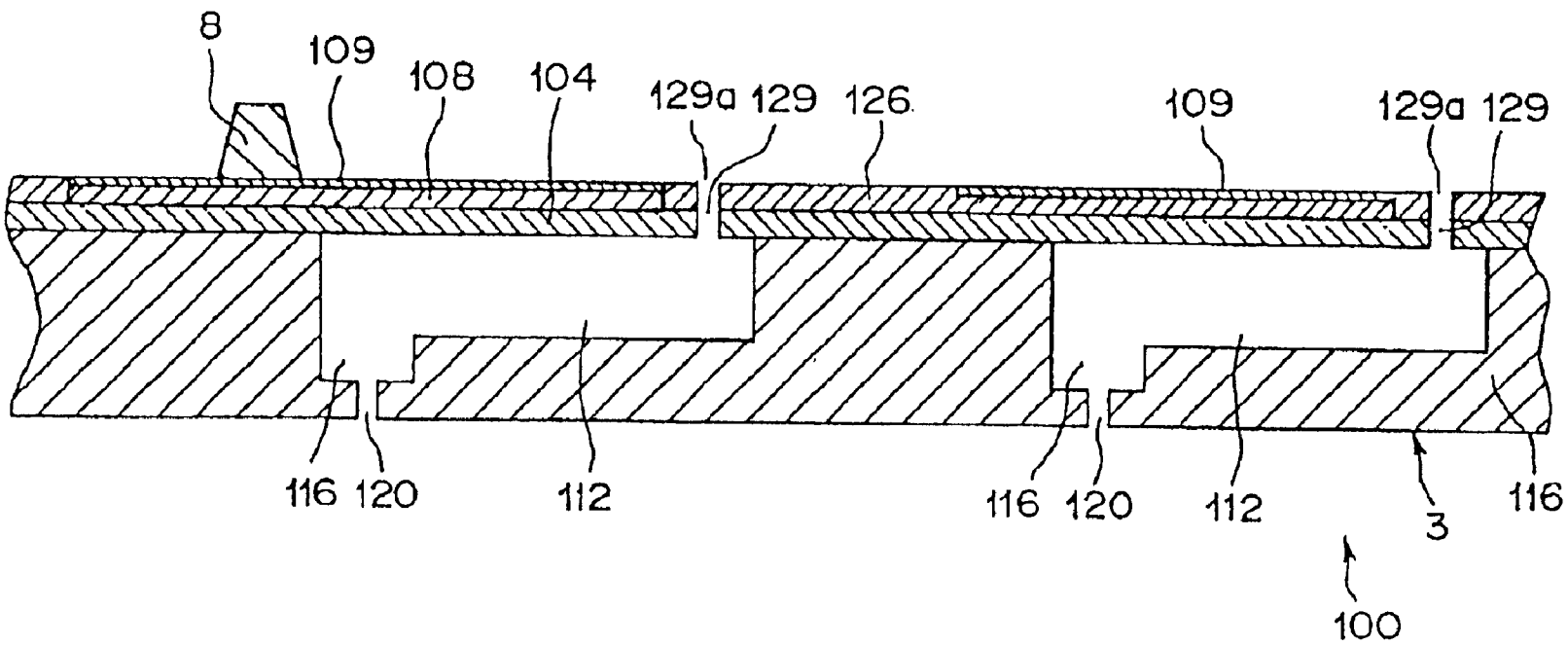
FIG. 8 is a sectional view taken along line A—A of FIG. 7.
Figure 9:
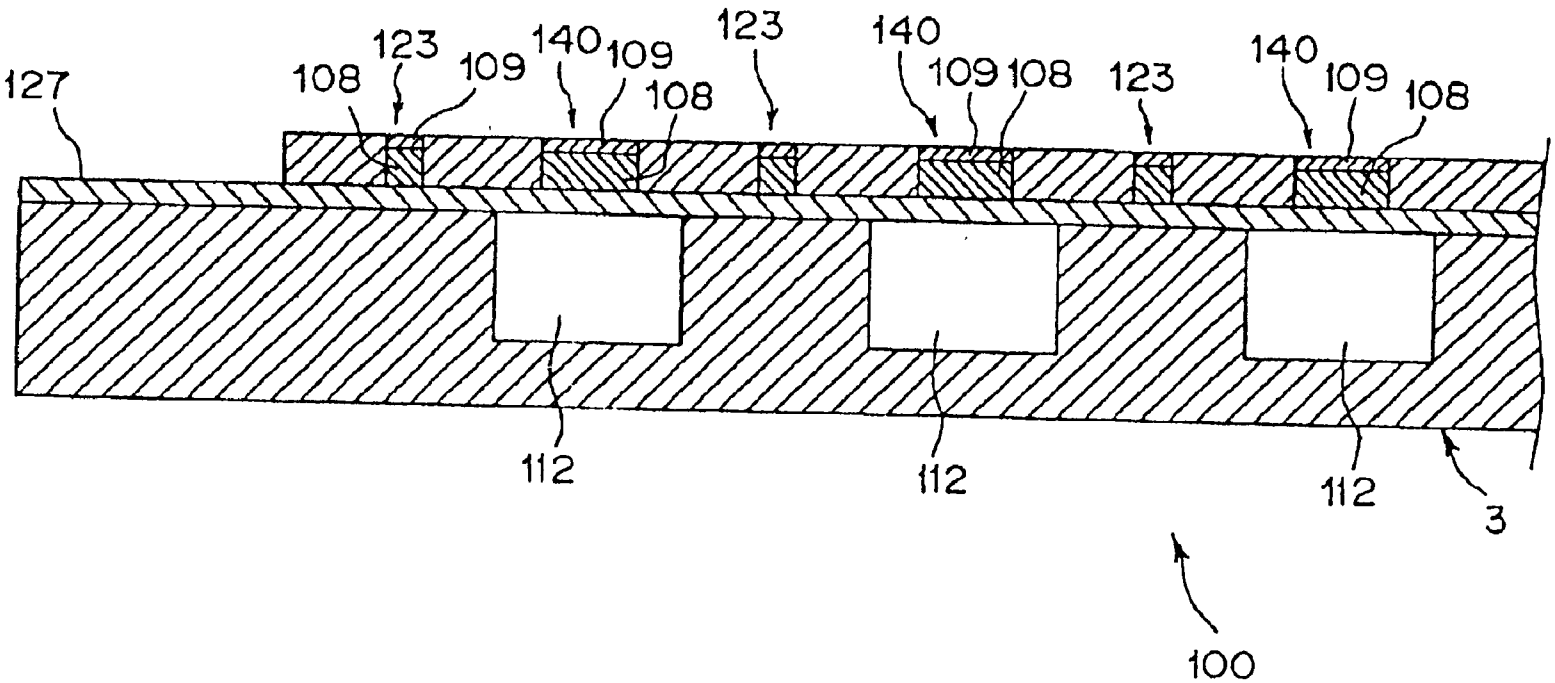

FIGS. 7 to 9 are views illustrating the shape of the wiring line patterns 123, and FIG. 7 is a plan view showing essential part of wiring patterns of the ink jet head as the first embodiment of the present invention in an enlarged scale, FIG. 8 is a sectional view taken along line A—A of FIG. 7, and FIG. 9 is a sectional view taken along line B—B of FIG. 7.

It is to be noted that, in FIGS. 8 and 9, the lamination structure of the dry film resist layer 103, stainless steel plate 105 and so forth is not shown for the convenience of illustration.

As shown in FIG. 7, the contact elements 121 are formed on the outer side (peripheral edge side) with respect to the framework member 8 on the face of the head body member 3 on which the individual electrodes 109 and so forth are formed, and the contact elements 121 and the individual electrodes 109 are electrically connected to each other individually by the wiring line patterns 123.

The wiring line patterns 123 are formed by patterning together with the individual electrodes 109 and the contact elements 121 on the head body member 3 as hereinafter described. Consequently, the wiring line patterns 123 are formed as a thin film integrally with and on the same plane as the individual electrodes 109 and the contact elements 121 from the same material.

The wiring line patterns 123 are disposed such that, as shown in FIGS. 7 to 9, they extend substantially in parallel to the longitudinal direction (leftward and rightward direction in FIG. 7) of the individual electrodes 109 between the individual electrodes 109 (pressure chambers 112). The wiring line patterns 123 are disposed further such that they extend on the lower side of the framework member 8, that is, between the head body member 3 and the framework member 8, as shown in FIG. 8.

Further, the diaphragm 104 is exposed on the face of the head body member 3 on which the individual electrodes 109 and so forth are formed on the outer side with resect to the framework member 8 in the proximity of corner portions of the head body member 3 thereby to form contact elements 127 as shown in FIG. 7.

The FPC 2 is electrically connected to the contact elements 121 and 127 in accordance with a method such as the TAB. Consequently, even when the ink tank 50 (ink tank securing member) is jointed to the framework member 8 as shown in FIG. 6, the individual electrodes 109 and the diaphragm 104 can be electrically connected to the FPC 2 which supplies a signal for controlling the pressurization elements 140 without being influenced by the ink tank 50.

It is to be noted that, although the contact elements 127 are formed lower than the other contact elements 121 by an amount corresponding to the piezoelectric elements 108 and the individual electrodes 109, this does not have an influence upon contact bonding connection of the FPC 2 and so forth because the piezoelectric elements 108 and the individual electrodes 109 are sufficiently thin, for example, such that the thickness of the piezoelectric elements 108 is approximately 2 to 3 $\mu$m and that of the individual electrodes 109 is approximately 0.2 $\mu$m.

Now, a method of producing the ink jet head of the present invention is described with reference to FIGS. 10 to 12. FIG.

Figure 11:
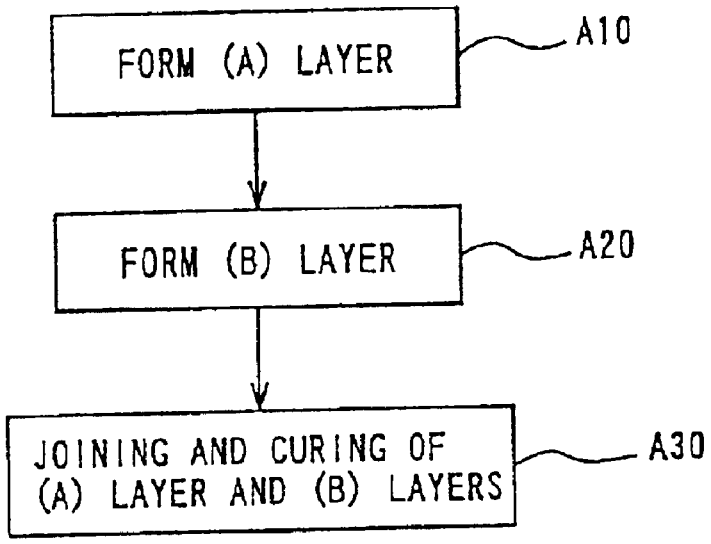
FIGS. 11 and 12 are flow charts illustrating a method of producing the ink jet head as the first embodiment of the present invention.
Figure 12:
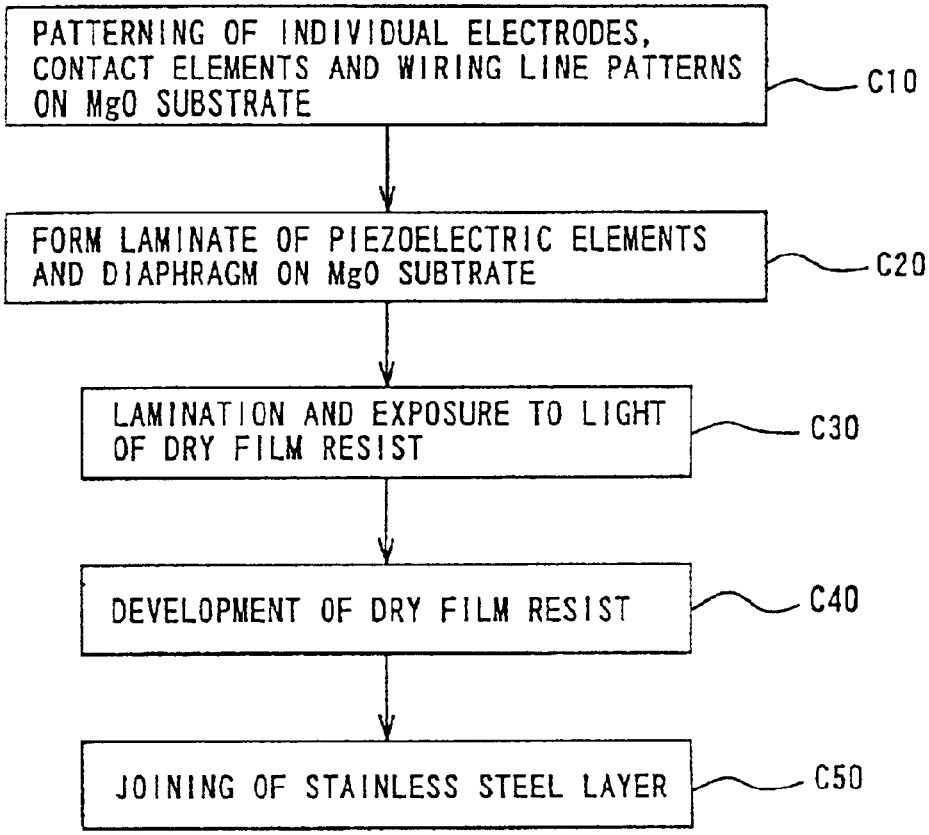

10 is a view illustrating a method of producing the ink jet head as the first embodiment of the present invention, and FIGS. 11 and 12 are flow charts illustrating the method of producing the ink jet head.

The ink jet head 100 of the present first embodiment is produced using a patterning technique in which a dry film resist is used, and is produced by forming two layers separately from each other and then curing them (steps A10 to A30 of FIG. 11). It is to be noted that only a portion including two adjacent pressure chambers is shown in FIG. 10 for the convenience of illustration. Further, each of the processes at steps A10 to A30 illustrated in FIG. 11 may be performed prior to the other steps or they may be performed concurrently.

Figure 10A:
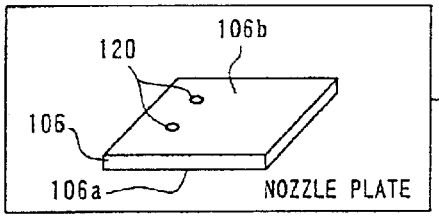
FIG. 10 is a view illustrating a method of producing the ink jet head as the first embodiment of the present invention.
Figure 10B:
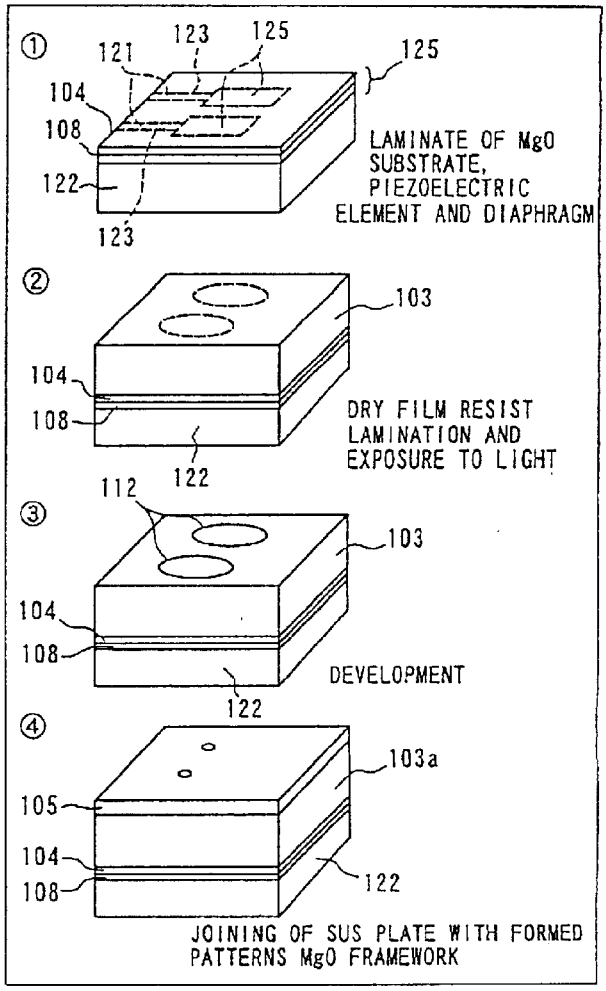
Figure 10C:
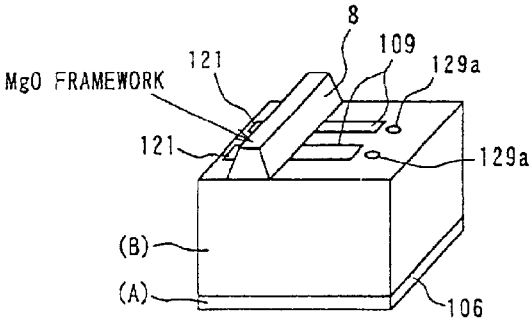

First, as shown in FIG. 10(*a*), a nozzle plate 106 ((A) layer) in which nozzles 120 are perforated is formed by micro press working of metal such as stainless steel (SUS) (step A10). Each of the nozzles 120 is worked preferably in a conical shape (tapering shape in section) such that it expands from a front face 106*a* of the nozzle plate 106 toward a rear face 106*b* (to be joined to the stainless steel plate 105) by punching (not shown) in which a pin is used or the like.

Then, such a (B) layer formed by laminating a bimorph laminate and a dry film resist layer as shown in FIG. 10(*b*) is formed (step A20 of FIG. 11).

The (B) layer includes a single layer of the dry film resist, and the step 20 of FIG. 11 more specifically includes steps C10 to C50 illustrated in FIG. 12.

First, as shown in circled 1 of FIG. 10(*b*), individual electrodes 109, contact elements 121 and wiring line patterns 123 are patterned on a MgO substrate 122 (step C10 of FIG. 12), and a bimorph laminate 125 formed from piezoelectric elements 108 and a diaphragm 104 is formed on the MgO substrate 122 (step C20 of FIG. 12).

More particularly, the piezoelectric elements 108 which form a single layer in the grating direction of the MgO substrate 122 are formed as a thin film by a technique of growing the thin film over one face of the MgO substrate 122 by sputtering, and then, a bimorph laminate 125 is formed on one face of the piezoelectric elements 108 by a technique of growing a chrome film, for example, by sputtering or plating.

At this time, resist is applied to the piezoelectric elements 108 formed over the overall face of the MgO substrate 122 first, and then it is patterned with a working pattern (including patterns for the ink supplying paths 129) of the piezoelectric elements 108 corresponding to the individual pressure chambers 112, whereafter an unnecessary portion of the piezoelectric elements 108 is removed by etching or the like.

Then, photosensitive liquid polyimide is applied to the overall face of the MgO substrate 122 on which the piezoelectric elements 108 are formed, and light is projected to the overall face of the MgO substrate 122 through the face opposite to the face of the MgO substrate 122 on which the piezoelectric elements 108 are formed using a glass mask or the like for intercepting the light for a pattern for the ink supplying paths 129 so as to expose only the polyimide immediately on the MgO substrate 122 to the light.

Thereafter, the photosensitive liquid polyimide is developed to remove the non-exposed polyimide at the locations of the piezoelectric elements 108 and the ink supplying paths 129 to dispose the polyimide layer 126 only in a region of the diaphragm 104 in which none of the piezoelectric elements 108 and the individual electrodes 109 is present.

Then, resist is formed at locations of the ink supplying paths 129 and a chrome film is formed over the overall area by sputtering, whereafter the resist is removed to form ink supplying paths 129 and a bimorph laminate 125.

It is to be noted that, by forming the piezoelectric elements 108 and the diaphragm 104 on the MgO substrate 122, the bimorph laminate 125 can be formed stably, and besides, a dry film resist layer 103 which is hereinafter described can be formed stably.

On the other hand, where a piezoelectric element having a laminate structure is used for the piezoelectric elements 108, for example, a plurality of green sheets are individually kneaded into solvent such as powder of ceramic until they become paste, and the paste is formed into a thin film of approximately 50 $\mu$m by a doctor plate. Here, a dielectric substance such as Ba, $TiO_3$, $PbTiO_3$ or $(NaK)NbO_3$ which are usually used as a material for a piezoelectric element may be used as a material for the piezoelectric elements 108.

In this instance, using a plurality of (for example, twelve) green sheets, first internal electrode patterns are formed by printing on one face of each of three ones of the green sheets while second internal electrodes are formed by printing on one face of each of different three ones of the green sheets. It is to be noted that the printing of the first and second internal electrodes is performed by applying paste formed by mixing powder of an alloy of silver and palladium into solvent and patterning the paste.

Then, the three green sheets on which the first internal electrodes are formed and the three green sheets on which the second internal electrodes are formed are adhered alternately to each other and the other six green sheets on which no internal electrode is formed are adhered to form a laminate structure of piezoelectric elements, and the green sheets in the laminated state are baked. In this instance, the green sheets having no internal electrode function as a substrate element.

Thereafter, dry film resist 103 is laminated on the diaphragm 104 as shown in circled 2 of FIG. 10(*b*), and then portions corresponding to pressure chambers 112 are exposed to light by a masking process (step C30 of FIG. 12).

Then, development is performed (step C40 of FIG. 12) as shown in circled 3 of FIG. 10(*b*) to form a laminate formed by lamination of the piezoelectric elements 108 to dry film resist layer 103 shown in FIG. 4 on the MgO substrate 122, and a stainless steel plate 105 from which portions corresponding to the communication paths 116 are removed in advance by etching is joined to the dry film resist layer 103 as shown in circled 4 of FIG. 10(*b*) (step C50 of FIG. 12).

Then, the (A) layer and the (B) layer are joined to each other and cured (step A3 of FIG. 11).

Thereafter, the dry film resist layer 103 is hardened by pressurization and heating so that the layers from the MgO substrate 122 to the nozzle plate 106 maybe integrated with each other.

Then, resist is applied to the face of the MgO and patterning light exposure is performed in a predetermined shape conforming with the shape of the framework member 8, whereafter the resist is developed. Further, an unnecessary portion of the MgO substrate 122 is removed so that the framework member 8 is formed as a remaining portion of the MgO substrate (substrate) 122 on the head body member 3.

The contact elements 121 and 127 of the head body member 3 formed in such a manner as described above are electrically connected to the FPC 2 by connection through Au bumps, and an ink tank (ink supplying part) 50 or an ink tank securing member formed by molding of resin or the like is adhered to the framework member 8 using a bonding agent or the like and then hardened thereby to complete the ink jet head 100.

It is to be noted that the process of removing the MgO substrate 122 to form the framework member 8 need not necessarily be performed after the (A) layer and the (B) layer are joined to each other and cured, but may be performed, for example, after the (B) layer is formed, and can be carried out in various modified forms without departing from the spirit and scope of the present invention.

The dimensions of individual portions of the ink jet head 100 as the first embodiment may be, for example, such as given below. Here, L represents the length, W the width, and t the thickness.

Individual electrode: L×W×t=1,700 (μm)×70 (μm)×0.2 (μm)

Wiring line pattern: W×t=5 (μm)×0.2 (μm)

(however, the length is different among different elements)

Piezoelectric element: L×W×t=1,700 (μm)×70 (μm)×3 (μm)

Diaphragm: t=2 (μm)

Pressure chamber: L×W×t=1,700 (μm)×100 (μm)×130 (μm)

Nozzle: ϕ20 (μm)×20 (μm)

MgO substrate: W×t=20 (mm)×0.3 (mm)

MgO etching taper angle: 45 (deg)

(However, this value varies depending upon etching conditions, and in the present first embodiment, the value given above was obtained by applying 80° C.×(h) with 50% solution of phosphoric acid.)

Nozzle pitch: 1/150 (inch)

Nozzle number: 64

Since the ink jet head 100 as the first embodiment of the present invention is configured in such a manner as described above, in order to perform printing, ink retained in the ink tank 50 is supplied into the ink staying space 130 through the ink supply port 51 and is further supplied from the ink staying space 130 into the pressure chambers 112 through the ink supplying paths 129.

Then, driving signals produced by the driving circuit not shown or the like are transmitted through the FPC 2 to the contact elements 121 and 127 so that the pressure chambers 112 are pressurized by the pressurization elements 140 to jet the ink from the nozzles 120 thereby to perform printing on the printing paper 200.

In this manner, with the ink jet head 100 and the ink jet printer (printing apparatus) 1 which includes the ink jet head 100 of the first embodiment of the present invention, since the ink staying space 130 and the pressure chambers 112 are communicated with each other individually by the ink supplying paths 129, ink from the ink tank 50 can be supplied directly into the pressure chambers 112, and there is no necessity to provide ink supplying ports for exclusive use in the head body member 3. Therefore, the degree of integration of the ink jet head 100 can be improved and the ink jet head 100 and hence the printing apparatus (ink jet printer 1) can be miniaturized, and the product ion cost can be reduced significantly. Further, supply of ink to the pressure chambers 112 can be made uniform, and the printing quality can be improved.

Further, the framework member 8 is provided in a projecting manner on the head body member 3 such that it surrounds the openings 129*a* of the plurality of ink supplying paths 129 on the outer face of the head body member 3, and besides the ink staying space 130 is formed by the framework member 8, head body member 3 and ink tank 50. Consequently, the rigidity of the head body member 3 can be raised, and the ink staying space can be formed readily.

Furthermore, since the rigidity of the head body member 3 can be raised by the framework member 8, also upon production of the ink jet head 100, the head body member 3 is less liable to be broken, and the productivity of the head body member 3 can be improved.

Besides, since the pressurization elements 140 include the diaphragm 104 which forms one face of the pressure chambers 112 and partitions the pressure chambers 112 and the ink staying space 130 from each other and the piezoelectric element 108 formed by lamination on the diaphragm 104 on the outer side of the pressure chambers 112 for driving the diaphragm 104 to pressurize the pressure chambers 112, the pressurization elements 140 can be formed with certainty and the readiness in production of the ink jet head 100 can be improved.

It is to be noted that, since the ink supplying paths 129 are formed such that they extend through the diaphragm 104 in a region of the piezoelectric element 108 other than the lamination region, when ink is supplied from the ink staying space 130 to the pressure chambers 112, there is no possibility that the piezoelectric elements 108 may be influenced by the ink because the ink does not contact with the piezoelectric elements 108.

Further, since the framework member 8 is used as a joining element for joining the ink tank 50 to the head body member 3, the ink tank 50 or the ink tank securing member can be joined readily to the head body member 3.

Furthermore, since the individual electrodes 109 and the contact elements 121 are electrically connected to each other by the wiring line patterns 123 formed as a thin film, they need not be wired in the air by wire bonding or the like. Consequently, the mounting density of nozzles can be raised and the ink jet head can be miniaturized. Further, there is no possibility that the head body member 3 may be damaged upon wire bonding, and there is no possibility that short-circuiting may occur between the wiring lines either.

Furthermore, the framework member 8 is formed in such a framework-like shape that it surrounds the individual electrodes 109 on the face of the head body member 3 on which the individual electrodes 109, contact elements 121 and 127 and wiring line patterns 123 are formed, and the contact elements 121 and 127 are disposed on the outer side with respect to the framework member 8. Consequently, the FPC 2 and the individual electrodes 109 can be electrically connected to each other readily and with certainty.

Further, when the ink tank 50 or the ink tank securing member is joined to the head body member 3, the adhesion width can be reduced. Consequently, the head body member 3 can be formed in a reduced size, and the ink jet head and hence the printing apparatus (ink jet printer) can be miniaturized.

Furthermore, upon electric connection between the individual electrodes 109 and the contact elements 121, since the wiring line patterns 123 are disposed such that they extend between the framework member 8 and the head body member 3, the individual electrodes 109 can be electrically connected to the FPC for supplying a signal for controlling the pressurization elements 140 without being influenced by the framework member 8.

Further, since the head body member 3 is formed on the MgO substrate 122 and the MgO substrate 122 is partially removed from the head body member 3 to form the ink staying space 130 and besides the framework member 8 is formed as a remaining portion of the MgO substrate 122 on the head body member 3, the framework member 8 can be produced readily at a low cost.

(B) Description of the First Modification to the First Embodiment

Figure 13A:
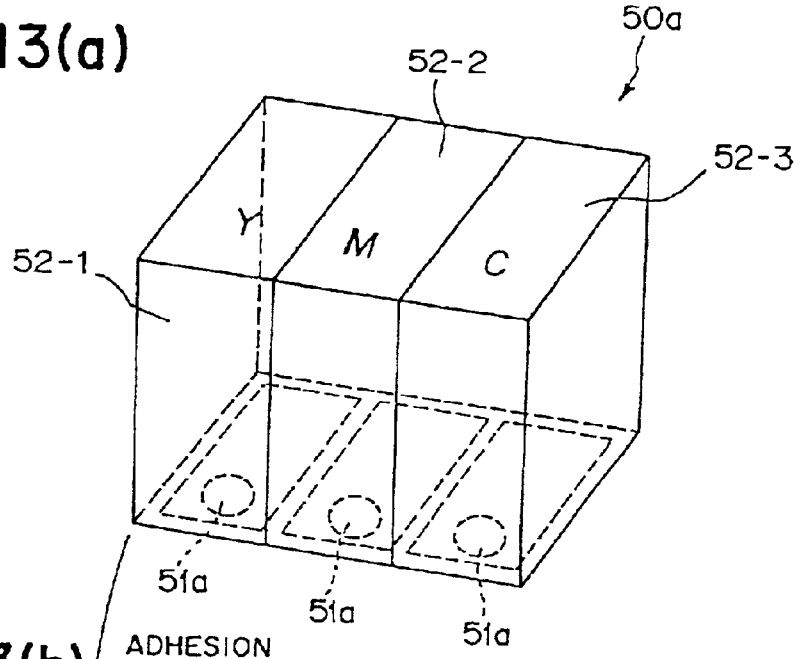
FIG. 13(*a*) is a perspective view showing an ink tank of an ink jet head as a first modification to the first embodiment of the present invention and illustrating a shape of the ink tank.
Figure 13B:
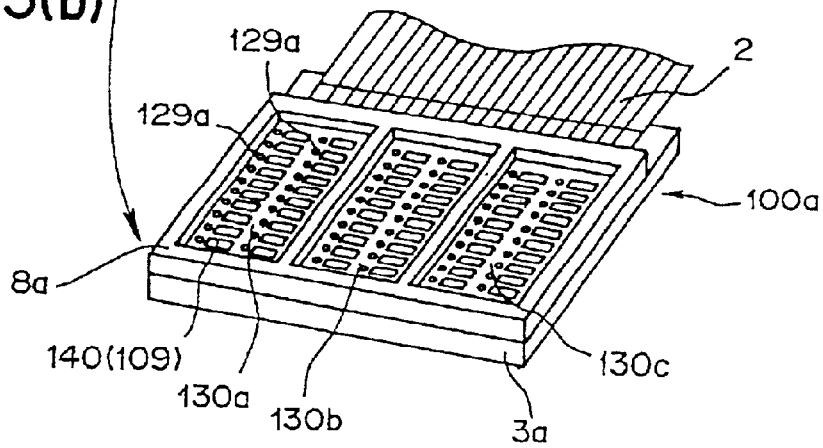

FIG. 13 is a view illustrating a first modification to the ink jet head of the first embodiment, and wherein FIG. 13(*a*) is a perspective view showing an ink tank of an ink jet head as a first modification to the first embodiment of the present invention and illustrating a shape of the ink tank and FIG. 13(*b*) is a perspective view showing a configuration of a head body member of the ink jet head as the first modification to the first embodiment of the present invention It is to be noted that, in FIG. 13, like reference characters to those appearing as above denote like or substantially, and therefore, detailed description of them is omitted.

As shown in FIGS. 13(*a*) and (*b*), the ink jet head 100*a* of the present first modification is used to perform color printing using a plurality of inks of different colors (in the present modification, three colors of yellow, magenta and cyan) and has nozzles (not shown) for discharging the inks of the colors. The ink jet head 100*a* includes a head body member 3*a* and a framework member 8*a*.

The head body member 3*a* includes a pressure chamber (not shown) and a pressurization element 140 for each of the plurality of nozzles (not shown).

The ink jet head 100*a* is joined to an ink tank (ink supplying part) 50*a* which retains the inks of the three colors of yellow, magenta and cyan through framework member 8*a*.

As shown in FIG. 13(*a*), the ink tank 50*a* includes a number of ink chambers 52-1 to 52-3 corresponding to the number of the inks to be used (three in the present first modification). The ink chambers 52-1 to 52-3 are partitioned from each other by partitions, and the inks of different types (colors) are filled in the ink chambers 52-1 to 52-3. In the present first modification, for example, ink of yellow is filled in the ink chamber 52-1, ink of magenta is filled in the ink chamber 52-2, and ink of cyan is filled in the ink chamber 52-3.

Each of the ink chambers 52-1 to 52-3 has an ink supply port 51*a* for supplying ink therethrough.

As shown in FIG. 13(*b*), six rows of pressure chambers (individual electrodes 109) are formed over a longitudinal direction of the head body member 3*a* (in FIG. 13(*b*), in a direction perpendicular to a side face to which an FPC 2 is connected). The pressure chambers are disposed such that they are aligned in one direction on the head body member 3*a* and disposed in parallel to each other as shown in FIG. 13(*b*).

For each of the pressure chambers, an ink supplying path having an opening 129*a* on an upper face (outer face) of the head body member 3*a* is formed in a similar manner as in the pressure chambers 112 of the ink jet head 100 of the first embodiment described hereinabove.

The head body member 3*a* includes a framework member (joining element) 8*a* provided in a projecting manner such that it surrounds openings 129*a* of the plurality of ink supplying paths on the outer face of the head body member 3*a*.

The framework member 8*a* is formed in a projecting manner on the face of the head body member 3*a* on the opposite side (on the side of the head body member 3*a* on which the individual electrodes 109 are formed) to the side on which the nozzles are formed. Further, the framework member 8*a* is formed such that it surrounds the individual electrodes 109 and the openings 129*a* on the face of the head body member 3*a* on which the individual electrodes 109 are formed.

Further, the framework member 8*a* partitions the pressurization elements 140 and the openings 129*a* in each two adjacent rows of the six rows of pressure chambers formed on the head body member 3*a* in a corresponding relationship to the ink chambers 52-1 to 52-3 of the ink tank 50*a*.

When the ink tank 50*a* or the ink tank securing member is joined to the framework member 8*a*, ink staying spaces 130*a* to 130*c* for allowing ink from the ink tank 50*a* to temporarily reside therein are formed between the head body member 3*a* and the ink tank 50*a*. The ink staying spaces 130*a* to 130*c* are partitioned from each other by part of the framework member 8*a*.

It is to be noted that, in the present first modification, ink of the ink chamber 52-1 is supplied into the ink staying space 130*a*, ink of the ink chamber 52-2 is supplied into the ink staying space 130*b*, and ink of the ink chamber 52-3 is supplied into the ink staying space 130*c*, each through the respective ink supply port 51*a*.

Also the framework member 8*a* has such a shape that that the width thereof decreases upwardly similarly to the framework member 8 of the ink jet head 100 of the first embodiment so that bonding agent protruding from the adhering faces thereof may be retained by the inclined faces thereby to prevent the protruding bonding agent from reaching the head body member 3*a*.

Further, the framework member 8*a* is formed as a remaining portion of a substrate made of magnesium oxide (MgO) by partly removing the substrate from the head body member 3*a* by a photo-etching process similarly to the frame member 8 and so forth of the ink jet head 100 of the first embodiment described hereinabove.

Further, a plurality of contact elements are formed in the proximity of an outer edge of the head body member 3, or more particularly, on the outer side with respect to the framework member 8*a*, on the face of the head body member 3*a* on which the openings 129*a* are formed, similarly as in the head body member 3 of the ink jet head 100 of the first embodiment.

Since the ink jet head 100*a* as the first modification to the first embodiment of the present invention is configured in such a manner as described above, if the ink tank 50*a* is first joined to the framework member 8*a* using a bonding agent or the like and then inks of the different colors are individually supplied from the ink supply ports 51*a* of the ink tank 50*a* into the ink staying spaces 130*a* to 130*c*, then the inks are supplied into the individual pressure chambers through the ink supplying paths.

Then, when a driving signal is supplied to each of the individual electrodes 109 through the FPC 2 by the drive circuit not shown or the like, the corresponding pressure chamber is pressurized by the pressurization element 140 to discharge the ink from the nozzle.

In this manner, operation and effects similar to those of the first embodiment described above are achieved also with the first modification to the first embodiment of the present invention. Further, also where a plurality of inks of different colors are used to perform printing, since the discharging amounts and so forth of the inks to be discharged from the nozzles can be made uniform, the printing quality can be improved.

Further, since adjacent ones of the ink staying spaces 130*a* to 130*c* are partitioned by the framework member 8*a*, a multi-nozzle ink jet head (ink jet head 10*a*) which can print in multiple colors can be formed with a high degree of position accuracy of the nozzles and the nozzles can be formed in a high density. Consequently, the ink jet head and hence the printing apparatus (ink jet printer) can be miniaturized.

(C) Description of the Second Modification to the First Embodiment

Figure 14:
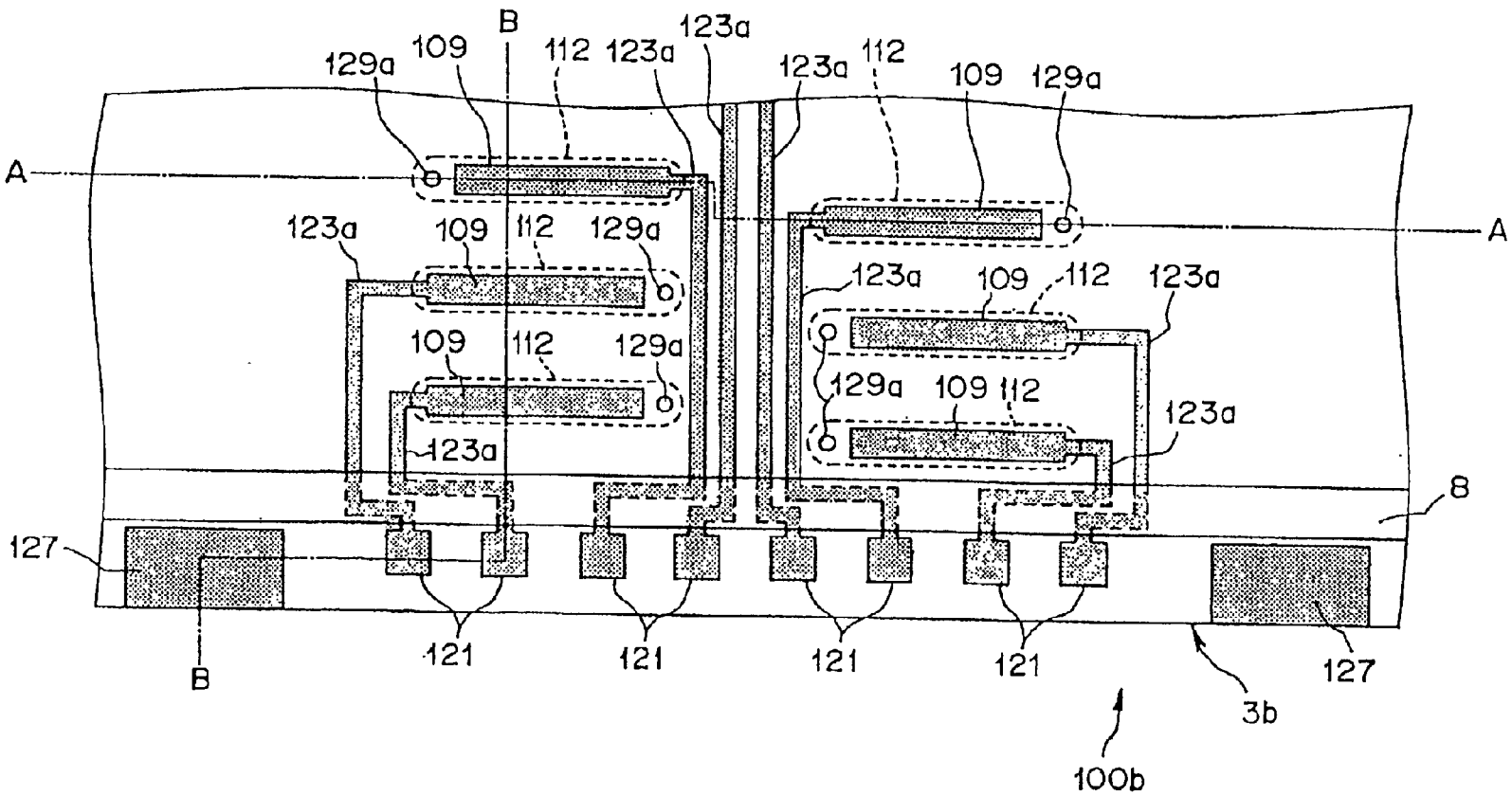
FIG. 14 is a plan view showing, in an enlarged scale, essential part of wiring patterns of an ink jet head as a second modification to the first embodiment of the present invention.
Figure 15:
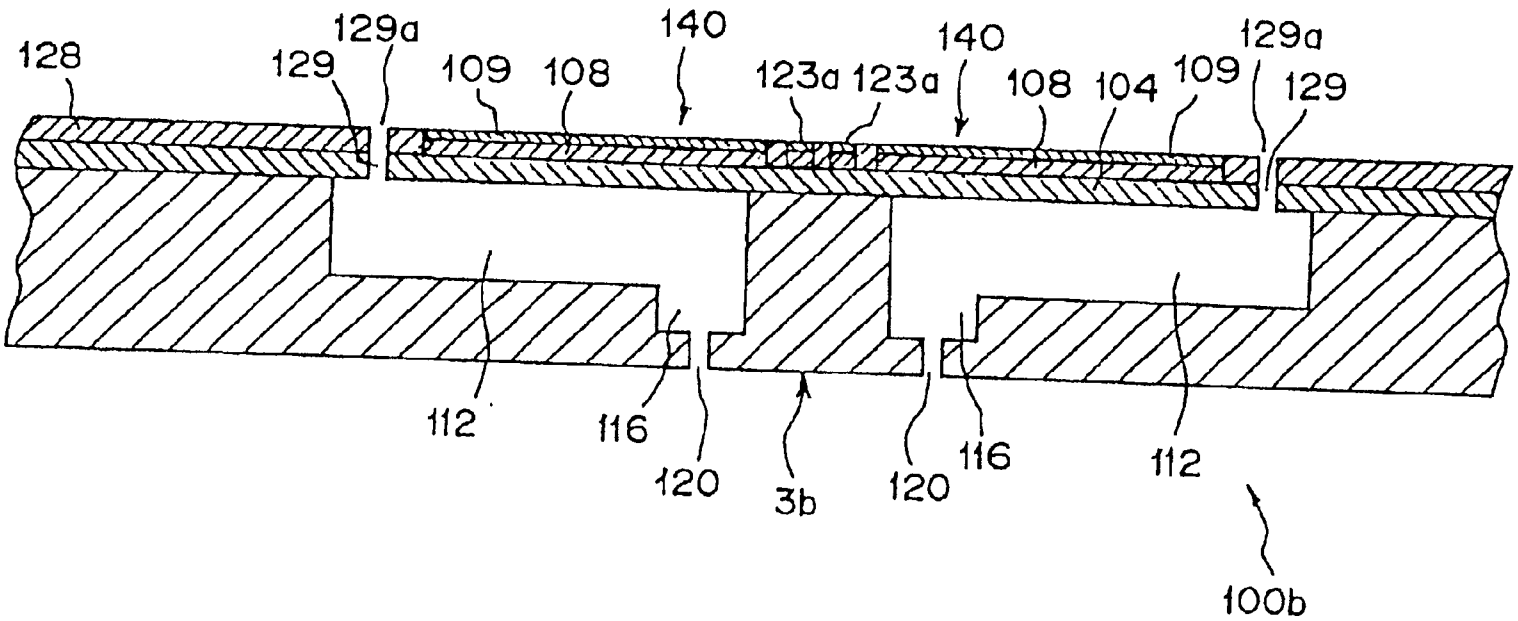
FIG. 15 is a sectional view taken along line A—A of FIG. 14.
Figure 16:
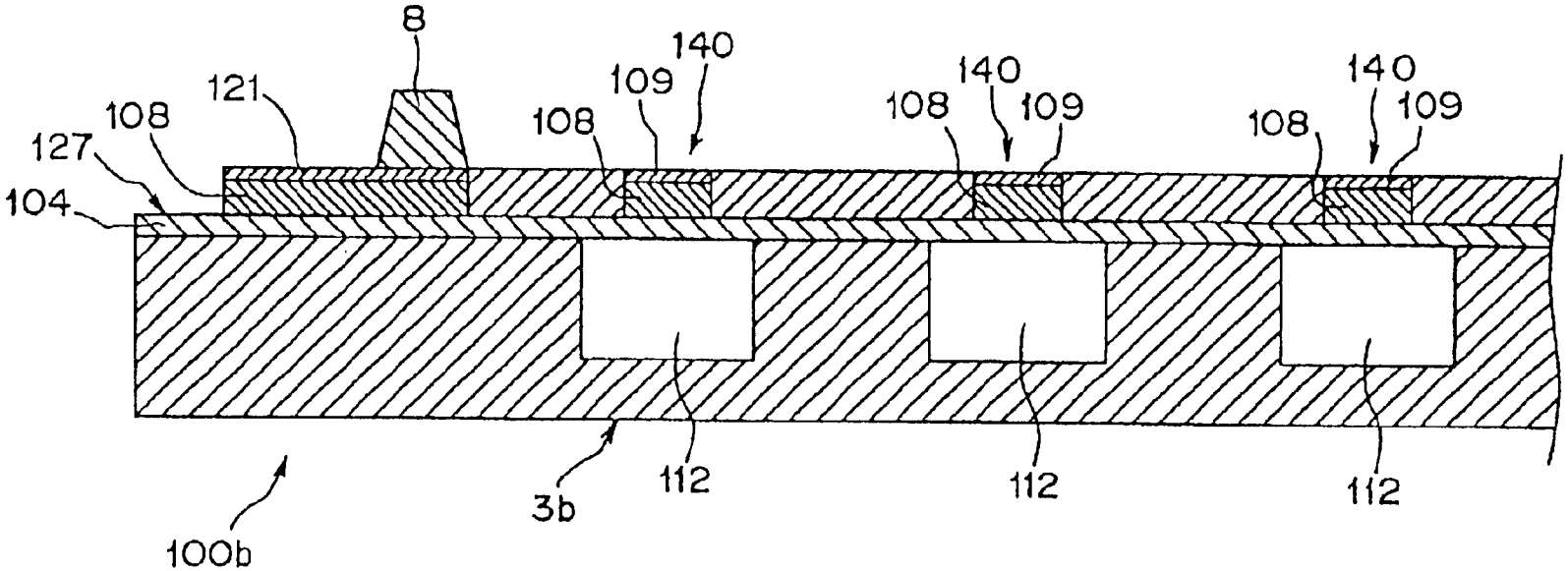
FIG. 16 is a sectional view taken along line B—B of FIG. 14.

FIGS. 14 to 16 are views illustrating a configuration of wiring line patterns of an ink jet head as a second modification to the ink jet head of the first embodiment, and wherein FIG. 14 is a plan view showing, in an enlarged scale, essential part of wiring patterns of the ink jet head as the second modification to the first embodiment of the present invention, FIG. 15 is a sectional view taken along line A—A of FIG. 14, and FIG. 16 is a sectional view taken along line B—B of FIG. 14.

It is to be noted that, in FIGS. 14 to 16, like reference characters to those appearing as above denote like or substantially like elements, and therefore, detailed description of them is omitted.

A ink jet head 100*b* as the second modification to the first embodiment of the present invention includes wiring line patterns 123*a* in place of the wiring line patterns 123 of the ink jet head 100 of the first embodiment. In the following, the ink jet head 100*b* is described in detail with reference to FIGS. 14 to 16.

As shown in FIGS. 14 to 16, also the ink jet head 100*b* of the present second modification has a plurality of nozzles 120 for discharging ink supplied thereto from an ink tank (ink supplying part) not shown similarly to the ink jet head 100 of the first embodiment described hereinabove and includes a head body member 3*b* and a framework member 8.

Also the ink jet head 100*b* of the present second modification is formed by lamination of a plurality of layers such as a dry film resist layer 103 and a stainless steel plate 105 similarly to the ink jet head 100 described hereinabove. However, the lamination structure of the ink jet head 100*b* is not shown in FIGS. 15 and 16 for the convenience of illustration.

As shown in FIGS. 14 to 16, wiring line patterns 123*a* are formed together with individual electrodes 109 and contact elements 121 on the head body member 3*b* by patterning. Thus, the wiring line patterns 123*a* are formed as a thin film integrally with and on the same plane as the individual electrodes 109 and the contact elements 121 from the same material.

As shown in FIG. 14, the wiring line patterns 123*a* are disposed such that they extend between and substantially in parallel to the longitudinal direction (leftward and rightward direction in FIG. 14) of the individual electrodes 109. Further, the wiring line patterns 123*a* are disposed such that they extends on the lower side of the framework member 8, that is, between the head body member 3*b* and the framework member 8 as shown in FIG. 16.

A diaphragm 104 is exposed on the face of the head body member 3*b* on the side on which the individual electrodes 109 and so forth are formed on the outer side with respect to the framework member 8, that is, in the proximity of the corners of the head body member 3*b* similarly as in the ink jet head 100 shown in FIG. 7. The exposed diaphragm 104 forms contact elements 127.

An FPC (external connection wiring line member; not shown in FIGS. 14 to 16) is electrically connected to the contact elements 121 and 127 using such a method as the TAB.

Also the ink jet head 100*b* of the present second modification is formed by a patterning technique using dry film resist 103 similarly as in the ink jet head 100 of the first embodiment. Further, also the wiring line patterns 123*a* are formed by patterning together with the individual electrodes 109 and the contact elements 121 on the head body member 3*b* and are formed as a thin film integrally with and on the same plane as the individual electrodes 109 and the contact elements 121.

With the configuration described above, if driving signals are supplied through the FPC to the individual electrodes 109 from a drive circuit or the like not shown after the FPC is connected to the contact elements 121 and 127 by such a system as the TAB, then the pressure chambers 112 are pressurized by the pressurization elements 140 to jet the ink from the nozzles 120.

In this manner, also with the ink jet head 100*b* as the second modification to the first embodiment of the present invention, upon electric connection between the individual electrodes 109 and the contact elements 121, the individual electrodes 109 can be electrically connected to the FPC for supplying a signal for controlling the pressurization elements 140 without being influenced by the framework member 8. Thus, similar operation and effects to those of the first embodiment described hereinabove can be achieved.

(D) Description of the Third Modification to the First Embodiment

Figure 17:
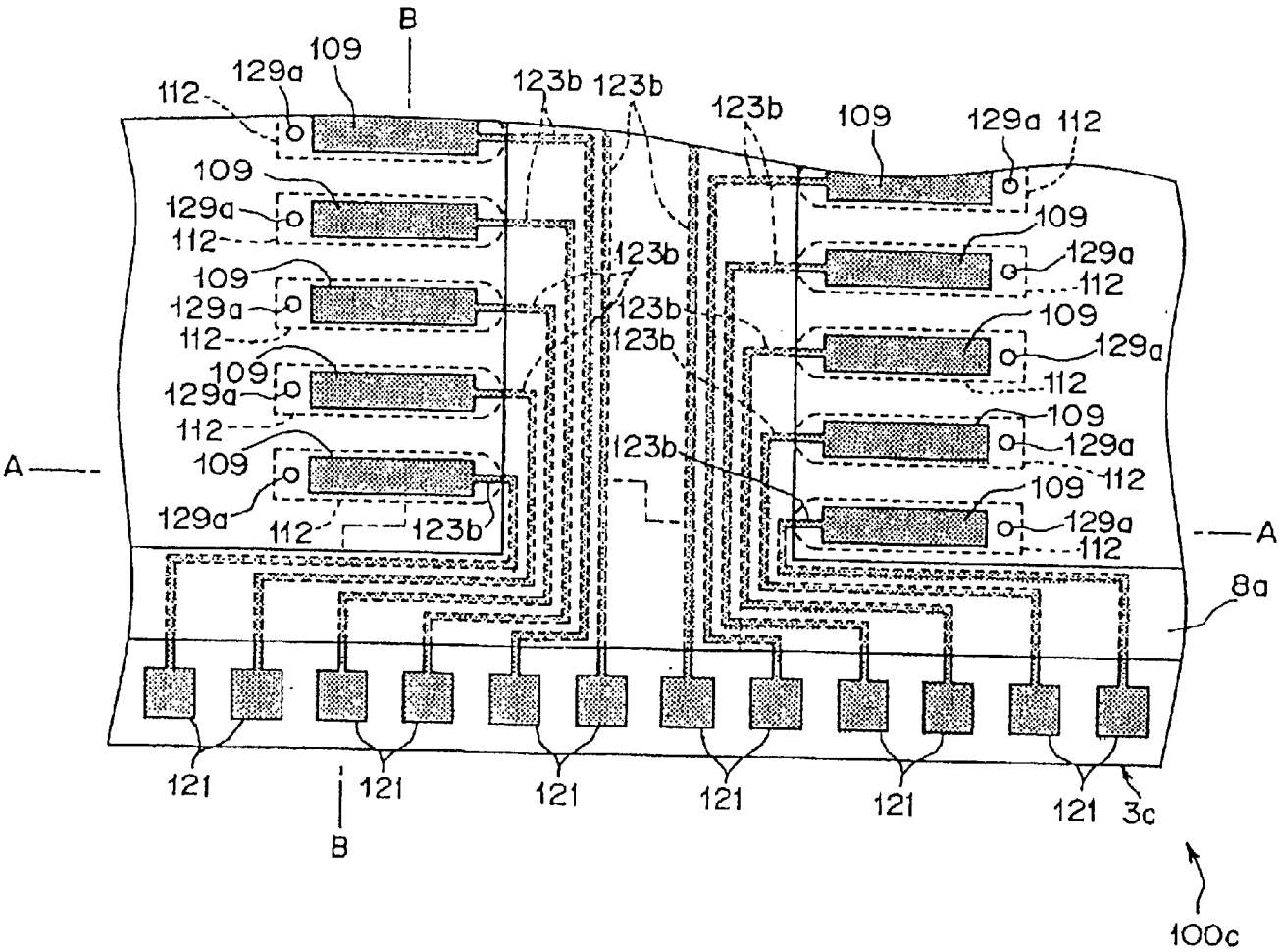
FIG. 17 is a plan view showing, in an enlarged scale, essential part of wiring line patterns of an ink jet head as a third modification to the first embodiment of the present invention.
Figure 18:
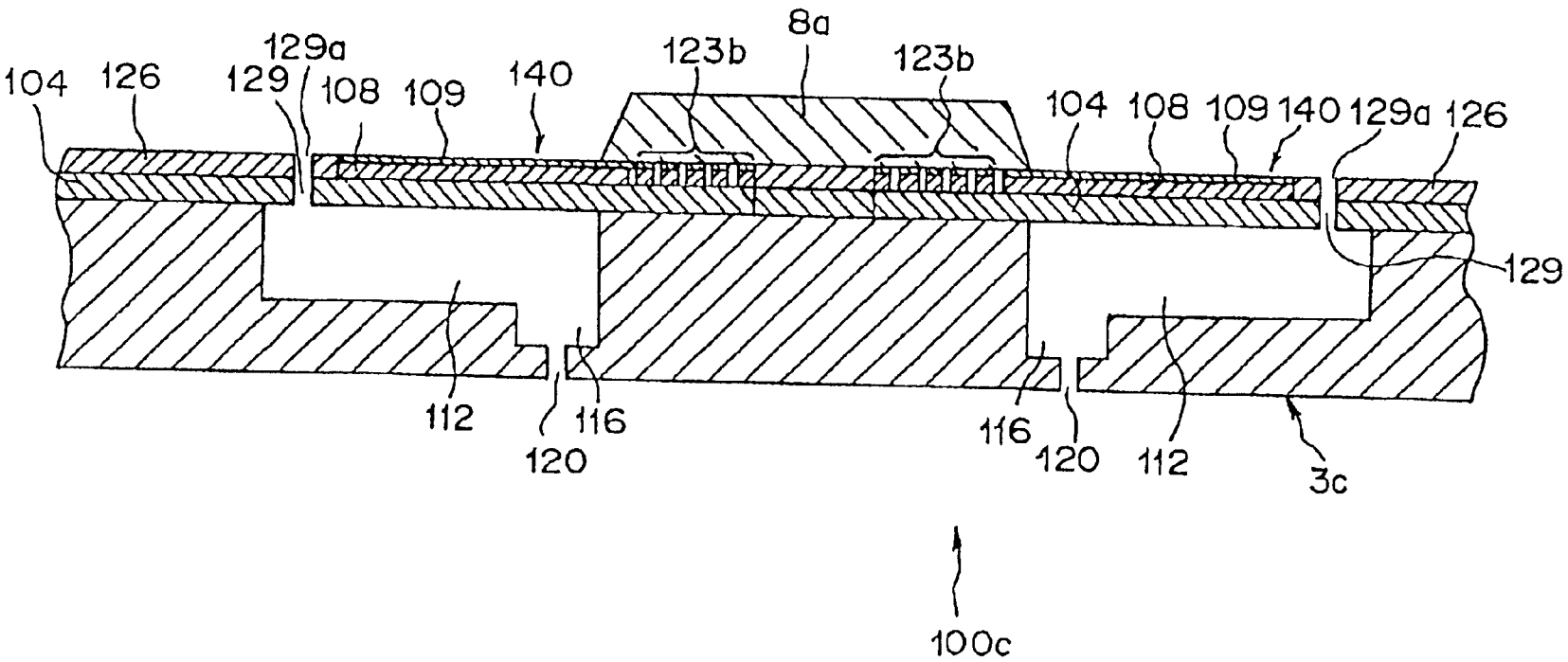
FIG. 18 is a sectional view taken along line A—A of FIG. 17.
Figure 19:
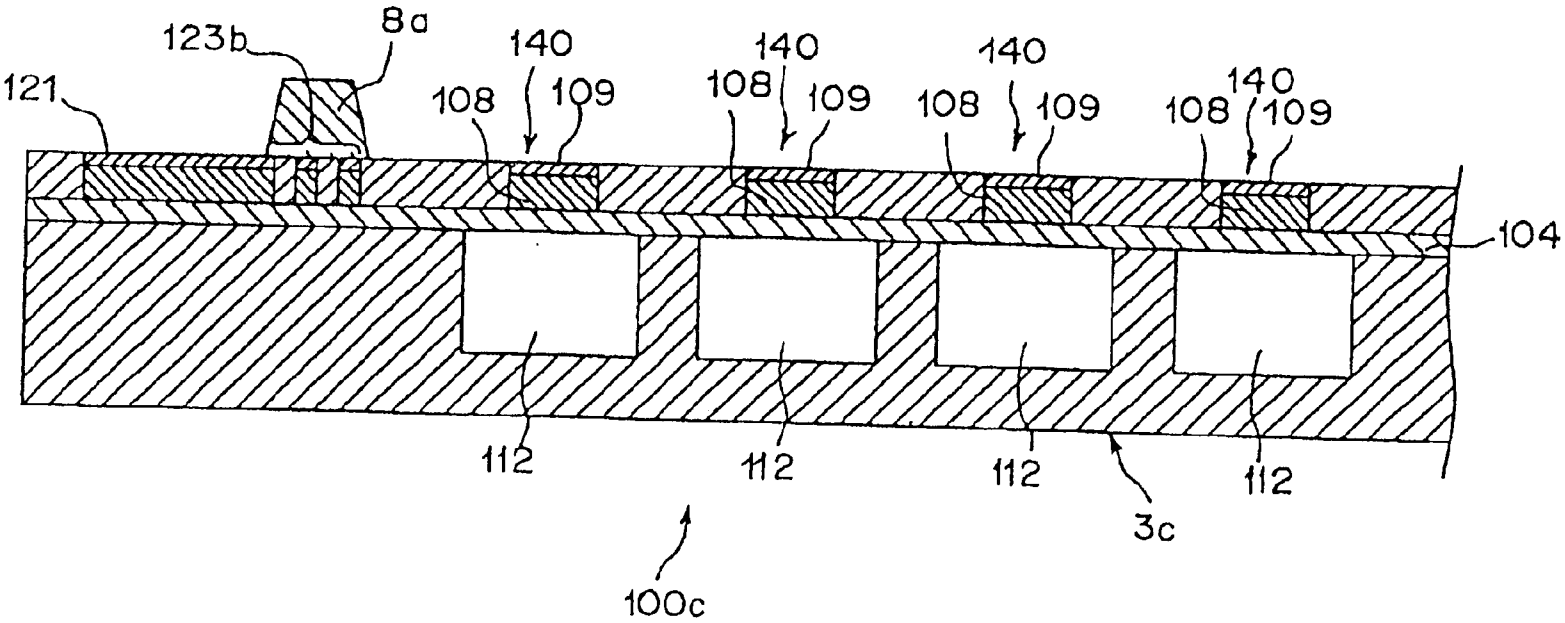
FIG. 19 is a sectional view taken along line B—B of FIG. 17.

FIGS. 17 to 19 are views illustrating a configuration of wiring patterns of an ink jet head 100*c* as a third modification to the first embodiment of the present invention, and wherein FIG. 17 is a plan view showing, in an enlarged scale, essential part of wiring line patterns of the ink jet head as the third modification to the first embodiment of the present invention, FIG. 18 is a sectional view taken along line A—A of FIG. 17, and FIG. 19 is a sectional view taken along line B—B of FIG. 17.

It is to be noted that, in FIGS. 17 to 19, like reference characters to those appearing as above denote like or substantially like elements, and therefore, detailed description of them is omitted.

The ink jet head 100*c* as the third modification to the first embodiment of the present invention includes wiring line patterns 123*b* in place of the wiring line patterns of the ink jet head 100*b* shown in FIG. 14 and so forth, and a configuration of the ink jet head 100*c* is described with reference to FIGS. 17 to 19.

It is to be noted that the present third modification is applied particularly to such an ink jet head 100*a* as shown in FIGS. 13(*a*) and (*b*).

As shown in FIGS. 17 to 19, also the ink jet head 100*c* of the present third modification has a plurality of nozzles 120 for discharging ink supplied thereto from an ink tank (ink supplying part; not shown in FIGS. 17 to 19) similarly to the ink jet heads 100*a* and 100*b* described hereinabove, and includes a head body member 3*c* and a framework member 8*a*.

Further, also the ink jet head 100*c* of the present third modification is formed by lamination of a plurality of layers such as a dry film resist layer 103 and a stainless steel plate 105 similarly to the ink jet head 100 described hereinabove. However, in FIGS. 18 and 19, the lamination structure of the ink jet head 100*c* is not shown for the convenience of illustration.

Furthermore, also the ink jet head 100*c* of the present third modification is formed by a patterning technique using dry film resist 103 similarly to the ink jet head 100, and also the wiring line patterns 123*b* are formed by patterning together with the individual electrodes 109 and the contact elements 121 on the head body member 3*c* and are formed as a thin film integrally from the same material and on the same plane as the individual electrodes 109 and the contact elements 121.

The wiring line patterns 123*b* are laid on the lower side of the framework member 8*a*, that is, between the head body member 3*c* and the framework member 8*a*, along the framework member 8*a* as shown in FIGS. 17 and 18, and are displaced from the framework member 8*a* at a position in the proximity of the contact elements 121 and connected to the contact elements 121.

Further, in the head body member 3*c*, a diaphragm 104 is exposed on the face of the head body member 3*c* on which the individual electrodes 109 and so forth are formed on the outer side with respect to the framework member 8*a*, that is, in the proximity of the corners of the head body member 3*c*, as shown in FIGS. 17 and 18, and thereby forms contact elements 127.

An FPC (external connection wiring line member; not shown in FIGS. 17 to 19) is electrically connected to the contact elements 121 and 127 by such a method as the TAB.

With the configuration described above, if the FPC is electrically connected to the contact elements 121 and 127 by such a method as the TAB and a driving signal is supplied to each of the individual electrodes 109 from a drive circuit or the like not shown through the FPC, then the corresponding pressure chamber 112 is pressurized by the pressurization element 140 to discharge ink from the nozzle 120.

In this manner, also with the ink jet head 100*c* as the third modification to the first embodiment of the present invention, upon electric connection between the individual electrodes 109 and the contact elements 121, the individual electrodes 109 can be electrically connected to the FPC for supplying a signal for controlling the pressurization elements 140 without being influenced by the framework member 8*a*. Thus, similar operation and effects to those of the second modification described hereinabove can be achieved. Further, since the wiring line patterns 123*b* are disposed between the framework member 8*a* and the head body member 3*c*, the wiring line patterns 123*b* are not exposed to the outside and consequently can be protected, and, for example, disconnection of a wiring line pattern 123*b* can be prevented.

(E) Description of the Fourth Modification to the First Embodiment

Figure 20:
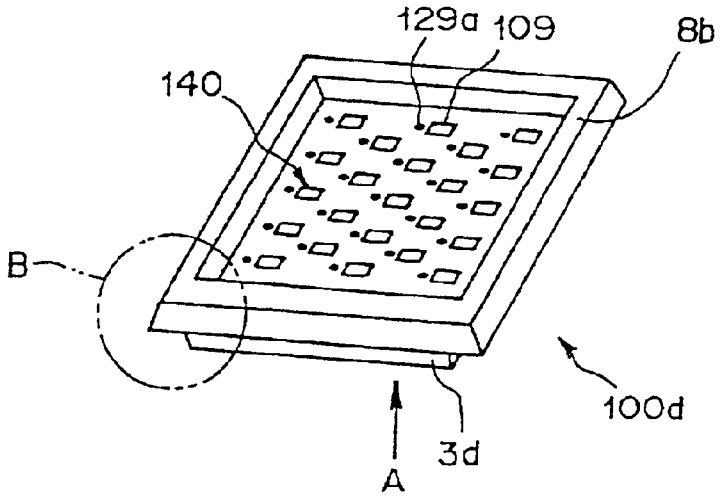
FIG. 20 is a perspective view showing a configuration of a head body member of an ink jet head as a fourth modification to the first embodiment of the present invention.
Figure 21:
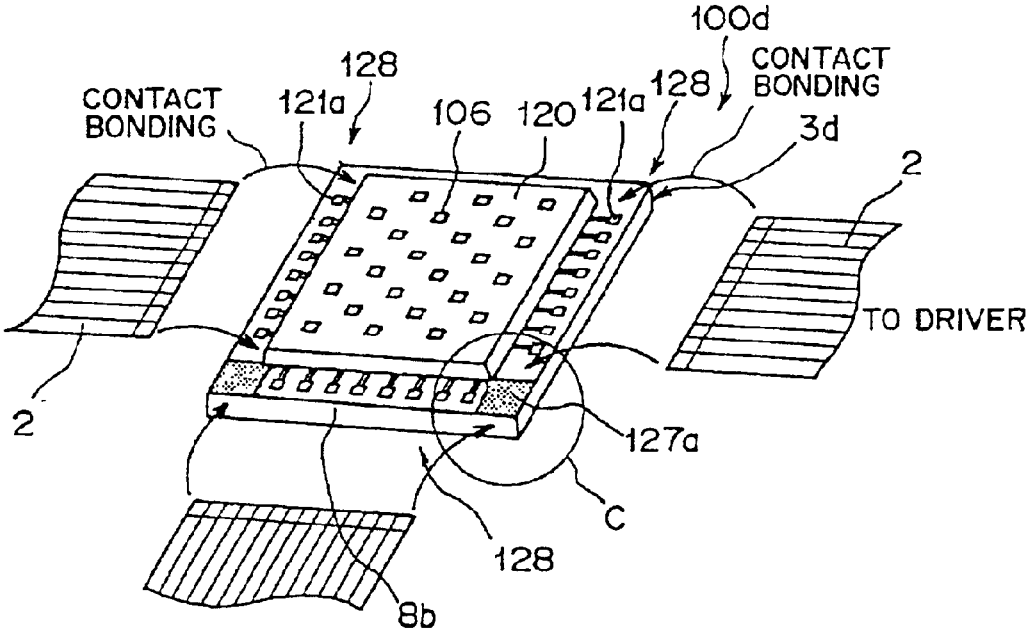
FIG. 21 is a view as viewed in the direction of an arrow mark A of FIG. 20.
Figure 22:
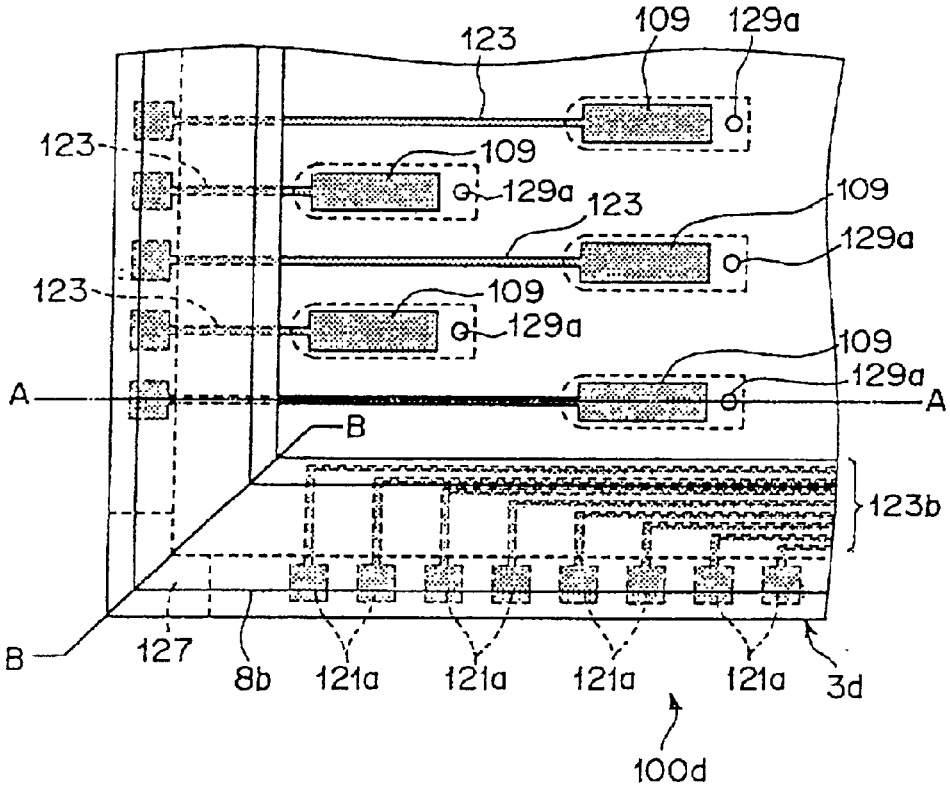
FIG. 22 is a plan view showing a B portion of FIG. 20 in an enlarged scale.
Figure 23:
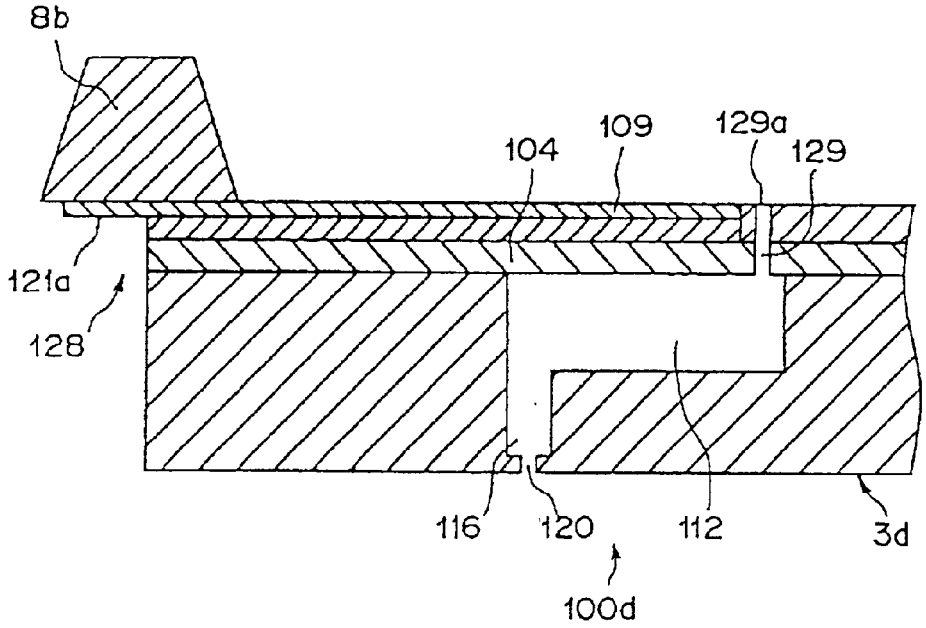
FIG. 23 is a sectional view taken along line A—A of FIG. 22.
Figure 24:
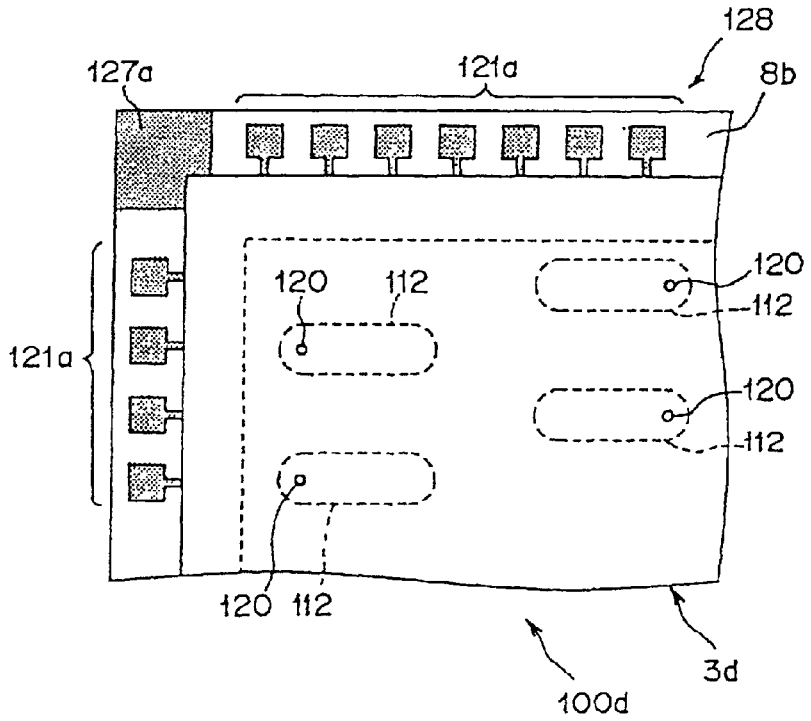
FIG. 24 is a plan view showing a C portion of FIG. 21 in an enlarged scale.
Figure 25:
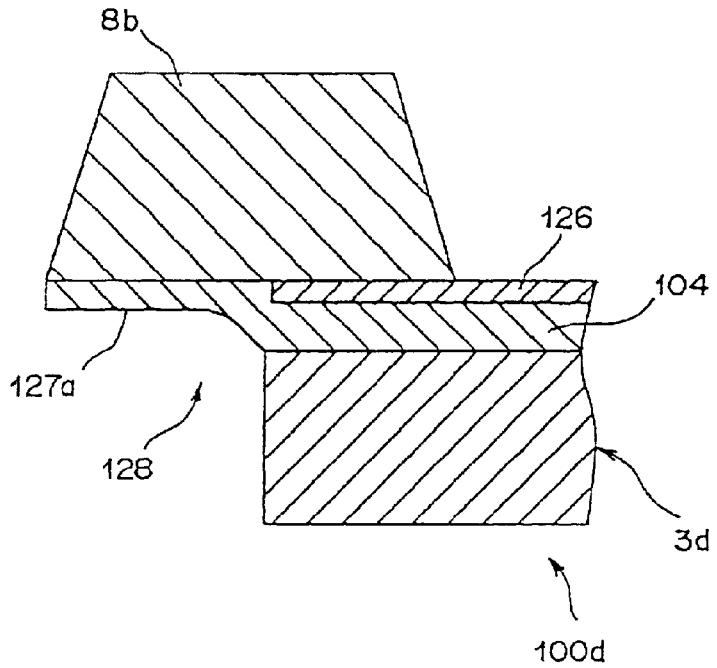
FIG. 25 is a sectional view taken along line B—B of FIG. 22.

FIGS. 20 to 25 illustrate a configuration of an ink jet head as a fourth modification to the first embodiment of the present invention, and wherein FIG. 20 is a perspective view showing a configuration of a head body member of the ink jet head as the fourth modification to the first embodiment of the present invention, FIG. 21 is a view as viewed in the direction of an arrow mark A of FIG. 20, FIG. 22 is a plan view showing a B portion of FIG. 20 in an enlarged scale, FIG. 23 is a sectional view taken along line A—A of FIG. 22, FIG. 24 is a plan view showing a C portion of FIG. 21 in an enlarged scale, and FIG. 25 is a sectional view taken along line B—B of FIG. 22.

It is to be noted that, in FIGS. 20 to 25, like reference characters to those appearing as above denote like or substantially like elements, and therefore, detailed description of them is omitted.

The ink jet head 100*d* as the fourth modification to the first embodiment of the present invention includes a framework member 8*b* in place of the framework member 8 of the ink jet head 100 shown in FIG. 1 and includes contact elements 121 on the framework member 8*b*. A configuration of the ink jet head 100*d* is described with reference to FIGS. 20 to 25.

As shown in FIG. 20, also the ink jet head 100*d* of the fourth modification to the present first embodiment has a plurality of nozzles 120 for discharging ink supplied thereto from an ink tank (ink supplying part; not shown in FIGS. 20 to 25) similarly to 100 of the first embodiment described hereinabove and includes a head body member 3*d* and a framework member 8*b* as shown in FIGS. 20 to 25.

It is to be noted that also the ink jet head 100*d* of the present fourth modification is formed by lamination of a plurality of layers such as a dry film resist layer 103 and a stainless steel plate 105 similarly to the ink jet head 100 described hereinabove. However, in FIGS. 23 and 25, the lamination structure of the ink jet head 100*d* is not shown for the convenience of illustration.

The head body member 3*d* includes a pressure chamber 112 and a pressurization element 140 provided for each of the plurality of nozzles 120.

The framework member 8*b* is formed, as shown in FIGS. 20 to 25, in a projecting manner on a face of the head body member 3*d* on the opposite side (side of the head body member 3*d* on which openings 129*a* are formed) to the side on which the nozzles 120 are formed and is formed in such a manner as to surround the openings 129*a* on the face of the head body member 3*d* on which the openings 129*a* are formed. Further, the framework member 8*b* is formed such that it extends outwardly from a peripheral edge of the head body member 3*d* as shown in FIGS. 23 and 25.

More particularly, in the present fourth modification, the framework member 8*b* is formed such that it projects at a substantially half portion thereof outwardly from the peripheral edge of the head body member 3*d* along the peripheral edge of the head body member 3*d*.

The framework member 8*b* is formed as a remaining portion of a substrate made of magnesium oxide (MgO) on the head body member 3*d* by partly removing the substrate from the head body member 3 by a photo-etching process similarly to the frame member 8 of the ink jet head 100 described hereinabove with reference to FIG. 1. An ink tank (ink supplying part; not shown) is joined to the framework member 8*b* using a bonding agent or the like to join the ink tank to the head body member 3*d*.

It is to be noted that also the framework member 8*b* of the ink jet head 100*d* of the present fourth modification has such a sectional shape that the width thereof decreases upwardly as shown in FIG. 23 so that bonding agent protruding from the adhering faces thereof may be retained by the inclined faces thereby to prevent the protruding bonding agent from reaching the head body member 3*d* (pressurization elements 140).

Further, contact elements 121*a* and 127*a* are formed on a face (this face is hereinafter referred to as contact element formation face 128) of the framework member 8*b* which projects outwardly farther than the peripheral edge of the head body member 3*d* on the opposite side (upper side in FIG. 21) to the side to which the ink tank is joined.

It is to be noted that, in the present fourth modification, the contact elements 127*a* are formed at the corner portions of the contact element formation face 128, and the contact elements 127*a* are formed integrally with the diaphragm 104 as shown in FIG. 25.

Further, a plurality of contact elements 121*a* are formed between the contact elements 127*a* of the contact element formation face 128. It is to be noted that the contact elements 121*a* are formed for individual ones of the individual electrodes 109.

It is to be noted that the positions of the contact elements 121*a* and 127*a* are not limited to them, but can be carried out in various modified forms without departing from the spirit and scope of the present invention.

Furthermore, the contact elements 121*a* and the individual electrodes 109 are electrically connected to each other by wiring line patterns 123 formed as a thin film.

In particular, in the present fourth modification, the contact elements 121*a* are disposed outwardly of the peripheral edge of the head body member 3*d* on the framework member 8*b* side and the contact elements 121*a* formed for individual ones of the individual electrodes 109 are disposed on the contact element formation face 128 of the framework member 8*b*, and the FPC 2 for supplying a signal for controlling the pressurization elements 140 is electrically connected to the contact elements 121*a* by such a technique as the TAB system.

With the configuration described above, if the FPC is electrically connected to the contact elements 121*a* and 127*a* as shown in FIG. 21 by such a system as the TAB and then a driving signal is supplied to each of the individual electrodes 109 from the driving circuit or the like not shown through the FPC, then the pressure chambers 112 are pressurized by the pressurization elements 140 to discharge ink from the nozzles 120.

In this manner, also with the ink jet head 100*d* of the fourth modification to the first embodiment of the present invention, upon electric connection between the individual electrodes 109 and the contact elements 121*a*, the individual electrodes 109 can be electrically connected to the FPC for supplying a signal for controlling the pressurization elements 140 without being influenced by the framework member 8*b*. Thus, similar operation and effects to those of the ink jet head 100 of the first embodiment described hereinabove can be achieved. Further, since the head body member 3*d* which forms the nozzles 120 can be formed smaller than the framework member 8*b*, the ink jet head 100*d* can be miniaturized.

Further, when the FPC 2 is connected to the contact elements 121*a* and 127*a*, since the contact elements 121*a* and the contact elements 127*a* have an equal height on the contact element formation face 128, electric connection upon connection of the FPC 2 can be established with a high degree of certainty.

Furthermore, when the FPC 2 is pressurized so as to be connected to the contact elements 121*a* and 127*a*, since the contact element formation face 128 is pressurized from the upper face of the FPC 2, the framework member 8*b* supports the contact element formation face 128. Consequently, the rigidity of the contact element formation face 128 is raised, and therefore, the stability in production can be improved.

(F) Description of the Fifth Modification to the First Embodiment

Figure 26:
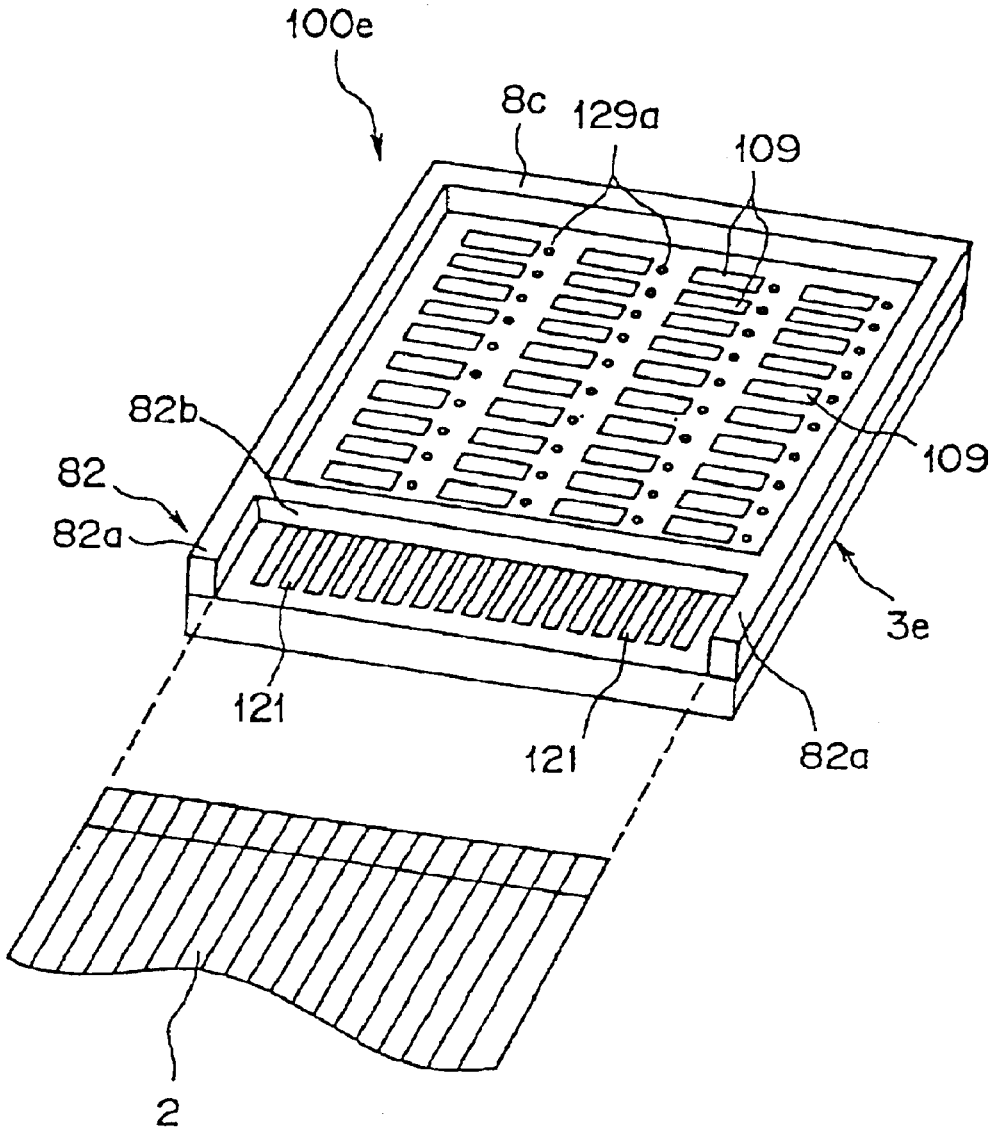
FIG. 26 is a perspective view showing a configuration of a head body member of an ink jet head as a fifth modification to the first embodiment of the present invention.

FIG. 26 is a perspective view showing a configuration of a head body member of an ink jet head as a fifth modification to the first embodiment of the present invention. Also the ink jet head 100*e* as the fifth modification to the first embodiment of the present invention has a plurality of nozzles (not shown) for discharging ink supplied thereto from an ink tank (ink supplying part; not shown in FIG. 26) similarly to the ink jet head 100*a* of the first modification described hereinabove, and includes a head body member 3*e* and a framework member 8*c*.

It is to be noted that, in FIG. 26, like reference characters to those appearing as above denote like or substantially like elements, and therefore, detailed description of them is omitted.

The framework member 8*c* is formed in a projecting manner on a face of the head body member 3*e* which is the opposite side (upper side in FIG. 26) to the side on which the nozzles are formed and on which openings 129*a* of ink supplying paths are formed. Further, the framework member 8*c* is formed in such a manner as to surround the plurality of openings 129*a* on the face of the head body member 3*e* on which the openings 129*a*, individual electrodes 109, contact elements 121 and wiring line patterns 123 are formed.

The framework member 8*c* is formed as a remaining portion of a substrate made of magnesium oxide (MgO) on the head body member 3*e* by partly removing the substrate from the head body member 3*e* by a photo-etching process. An ink tank (ink supplying part) or an ink tank securing member is joined to the framework member 8*c* using a bonding agent or the like to join the ink tank 50 to the head body member 3*e*.

Further, the framework member 8*c* has such a sectional shape that the width thereof decreases upwardly so that bonding agent protruding from the adhering faces thereof may be retained by the inclined faces thereby to prevent the protruding bonding agent from reaching the head body member 3*e*.

Furthermore, in the framework member 8*c*, a pair of opposing ones of members which form the framework member 8*c* project in the same direction in parallel to each other thereby to form a positioning portion 82. The pair of members projecting from the framework member 8*c* are referred to as projecting portions and are denoted by reference character 82*a*.

The positioning portion 82 includes a pair of projecting portions 82*a*, and an outer peripheral face 82*b* at portions of the framework member 8*c* at which the pair of projecting portions 82*a* are formed.

Also the pair of projecting portions 82*a* and the framework member 8*c* are formed as a remaining portion of a substrate made of magnesium oxide (MgO) on the head body member 3*e* by partly removing the substrate from the head body member 3*e* by a photo-etching process similarly to the framework member 8 of the ink jet head 100 of the first embodiment and so forth described hereinabove.

Further, a plurality of contact elements 121 and 127 are formed on a face of the head body member 3*e* on which the individual electrodes 109, wiring line patterns 123 and so forth are formed on the outer side with respect to the framework member 8*c* between the pair of projecting portions 82*a*.

With such a configuration as described above, an end face of the FPC (external connection wiring line member) 2 is contacted with the outer peripheral face 82*b* between the pair of projecting portions 82*a* to effect positioning of the FPC 2 with respect to the contact elements 121, and then the FPC 2 is electrically connected to the contact elements 121 and 127 by the TAB system.

In this manner, with the ink jet head 100*e* as the fifth modification to the first embodiment of the present invention, since positioning of the FPC 2 with respect to the contact elements 121 can be performed by contacting the end face of the FPC 2 with the outer peripheral face 82*b* between the pair of projecting portions 82*a*, the FPC 2 and the contact elements 121 and 127 can be electrically connected to each other with certainty. Further, since the necessity for a part for exclusive use for positioning the FPC 2 is eliminated, the number of components of the ink jet head 100*e* can be reduced.

(G) Description of the Sixth Modification to the First Embodiment

Figure 27:
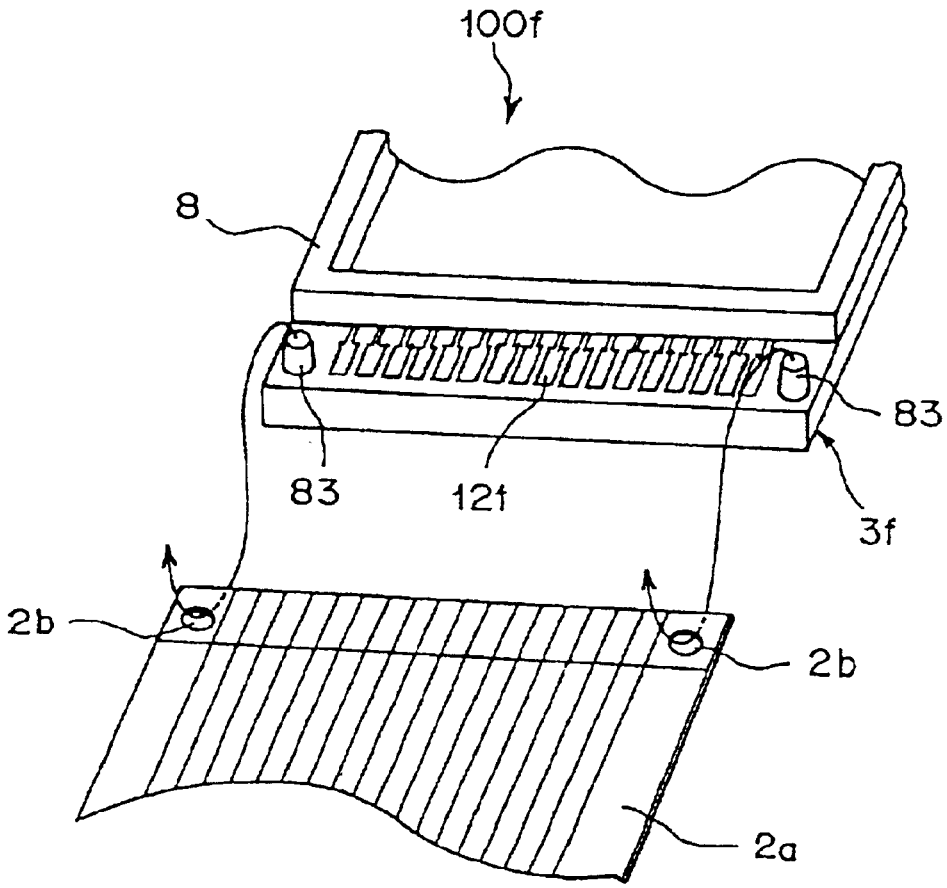
FIG. 27 is a perspective view showing a configuration of essential part of an ink jet head as a sixth modification to the first embodiment of the present invention.

FIG. 27 is a perspective view showing a configuration of essential part of an ink jet head as a sixth modification to the first embodiment of the present invention. Also the ink jet head 100*f* as the sixth modification has a plurality of nozzles (not shown) for discharging ink supplied thereto from an ink tank (ink supplying part; not shown in FIG. 27) similarly to the ink jet head 100*e* of the fifth modification described hereinabove, and includes a head body member 3*f* and a framework member 8.

As shown in FIG. 27, the ink jet head 100*f* of the present sixth modification includes a framework member 8 in place of the framework member 8*c* of the ink jet head 10*e* shown in FIG. 26 and additionally includes positioning elements 83.

It is to be noted that, in FIG. 27, like reference characters to those appearing as above denote like or substantially like elements, and therefore, detailed description of them is omitted.

A pair of positioning elements 83 each substantially in the form of a column are formed at corner portions of at least one of the sides which form a peripheral edge of the head body member 3*f* on the outer side with respect to the framework member 8 on a face of the head body member 3*f* on which individual electrodes 109, wiring line patterns 123 and so forth are formed. Further, a plurality of contact elements 121 and 127 are formed between the pair of positioning elements 83.

Also the pair of positioning elements 83 are formed as a remaining portion of a substrate made of magnesium oxide (MgO) on the head body member 3*f* by partly removing the substrate from the head body member 3*f* by a photo-etching process similarly to the framework member 8 of the ink jet head 100 of the first embodiment and so forth described hereinabove.

Further, at positions of an FPC 2*a* in the proximity of end portions corresponding to the positioning elements 83 described above, positioning holes 2*b* having a sectional shape substantially same as that of the positioning elements 83 are formed.

With such a configuration as described above, the positioning holes 2*b* formed in the FPC (external connection wiring line member) 2*a* are individually fitted with the positioning elements 83 to effect positioning of the FPC 2*a* with respect to the contact elements 121 and 127, and then the FPC 2*a* is electrically connected to the contact elements 121 and 127 by the TAB system.

In this manner, with the ink jet head 100*f* as the sixth modification to the first embodiment of the present invention, by fitting the positioning holes 2*b* formed in the FPC 2*a* individually with the positioning elements 83, positioning of the FPC 2*a* with respect to the contact elements 121 and 127 can be performed. Consequently, the FPC 2 and the contact elements 121 and 127 can be electrically connected to each other with certainty.

(H) Description of the Second Embodiment

Figure 28A:
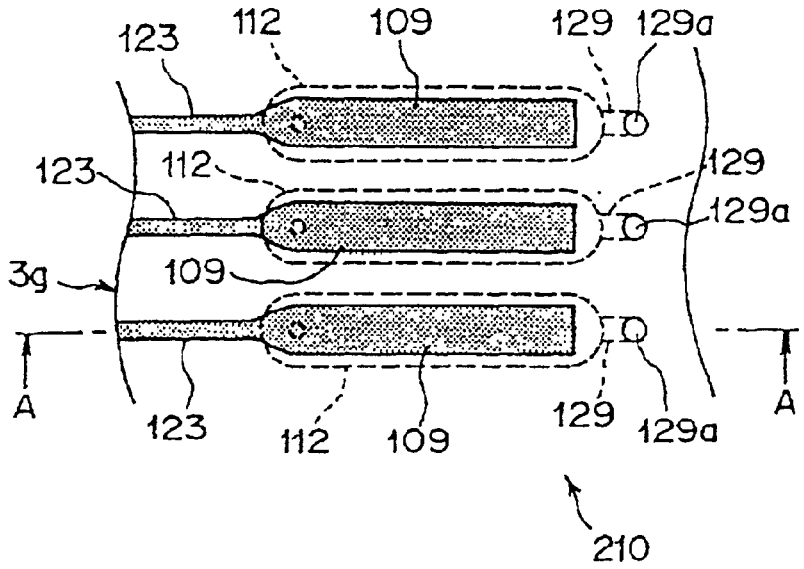
FIG. 28(*a*) is a plan view showing, in an enlarged scale, essential part of wiring line patterns of an ink jet head as a second embodiment of the present invention.
Figure 28B:
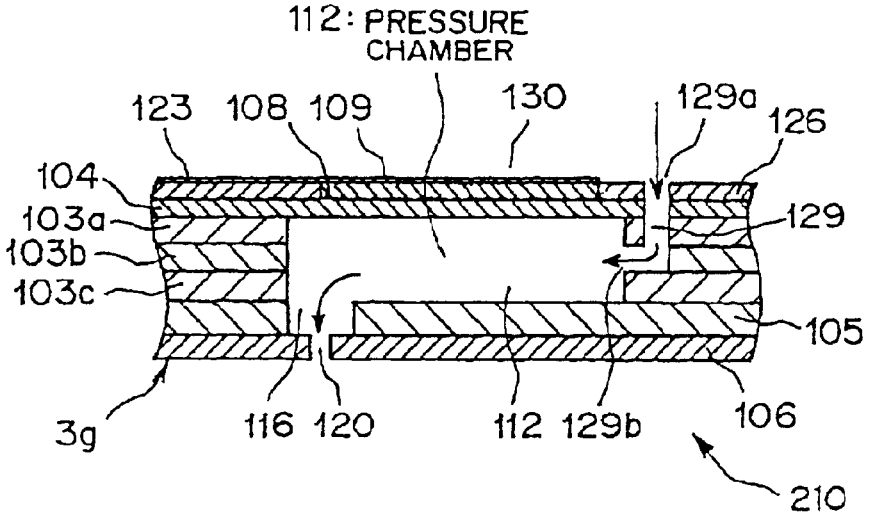

FIGS. 28(*a*) and (*b*) illustrate a configuration of an ink jet head as a second embodiment of the present invention, and wherein (a) is a plan view showing, in an enlarged scale, essential part of wiring line patterns of the ink jet head as the second embodiment of the present invention and (b) is a sectional view taken along line A—A of FIG. 28(*a*).

It is to be noted that, in FIG. 28, like reference characters to those appearing as above denote like or substantially like elements, and therefore, detailed description of them is omitted.

In the ink jet head 210 as the second embodiment of the present invention, ink supplying paths 129 are formed at positions different from those in the ink jet head 100 of the first embodiment, and detailed description thereof is given below with reference to FIGS. 28(*a*) and (*b*).

As shown in FIGS. 28(*a*) and (*b*), also the ink jet head 210 of the present second embodiment has a plurality of nozzles 120 for discharging ink supplied thereto from an ink tank (ink supplying part) not shown similarly to the ink jet head 100 of the first embodiment described hereinabove, and includes a head body member 3*g*.

In each pressure chamber 112, on one of faces thereof which is not formed by a diaphragm 104 and is not opposed to the face formed by the diaphragm 104 and besides is positioned farthest from the nozzle 120, one end side (hereinafter referred to as opening 129*b*) of the ink supplying path 129 is open. Meanwhile, the other end side (opening 129*a*) of the ink supplying path 129 is open to the ink staying space 130 on the outer face of the head body member 3*g*.

It is to be noted that also the ink jet head 210 of the present second embodiment is formed by lamination of a plurality of layers such as dry film resist 103 (103*a* to 103*c*) and a stainless steel plate 105 similarly to the ink jet head 100 described hereinabove. The head body member 3*g* includes three layers of dry film resist 103*a* to 103*c*. The pressure chambers 112 are formed by partly removing the dry film resist layers 103*a* to 103*c*.

Further, the dry film resist layers 103*a* and 103*b*, diaphragm 104 and polyimide layer 126 are partly removed to form ink supplying paths 129.

In other words, in the present second embodiment, each of the ink supplying paths 129 is formed such that it is open in a face of a pressure chamber 112 other than the face formed from the diaphragm 104.

Wiring line patterns 123 are formed by patterning together with the individual electrodes 109 and contact elements (not shown) on the head body member 3*g* as shown in FIG. 28(*a*). Consequently, the wiring line patterns 123 are formed as a thin film from the same material on the same plane as and integrally with the individual electrodes 109 and the contact elements.

With the configuration described above, if an ink tank (not shown) is joined directly (or through an ink tank securing member) to a framework member not shown and ink is supplied from the ink supply port of the ink tank into the ink staying space 130, then the ink temporarily resides in the ink staying space 130. Thereafter, the ink is supplied from the ink staying space 130 into the pressure chambers 112 through the ink supplying paths 129.

Then, if driving signals are supplied through the FPC to the individual electrodes 109 from a drive circuit or the like not shown after the FPC is electrically connected to the contact elements by such a system as the TAB, then the pressure chambers 112 are pressurized by the pressurization elements 140 to jet the ink from the nozzles 120.

In this manner, with the ink jet head as the second embodiment of the present invention, similar operation and effects to those of the first embodiment described above can be achieved. Further, since the ink supplying paths 129 are formed so as to open in a face other than the face formed from the diaphragm 104, even if the piezoelectric elements 108 or the diaphragm 104 is deformed, the ink supplying path 129 does not have an influence of deformation of the piezoelectric elements or the diaphragm 104 such as, for example, a loss of pressure and the rigidity of the pressure chambers 112 can be maintained and besides the pressurization operation is stabilized.

(I) Description of the Third Embodiment

Figure 29A:
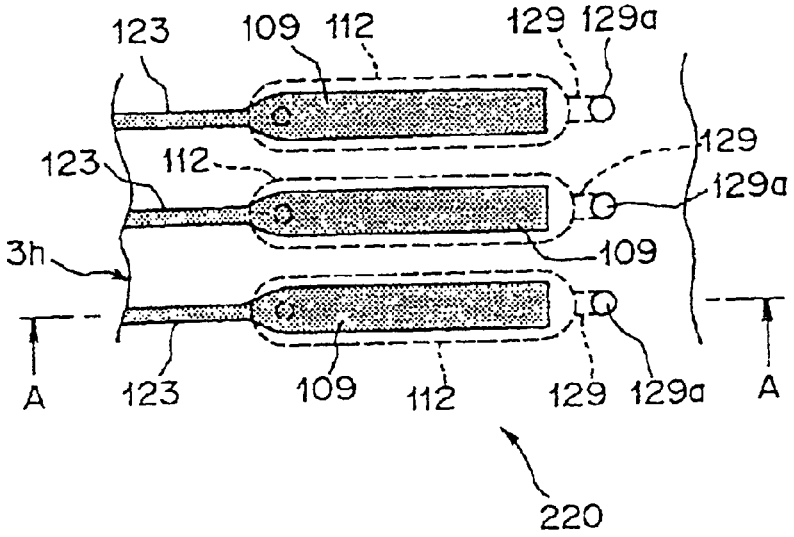
FIG. 29(*a*) is a plan view showing, in an enlarged scale, essential part of wiring line patterns of an ink jet head as a third embodiment of the present invention.
Figure 29B:
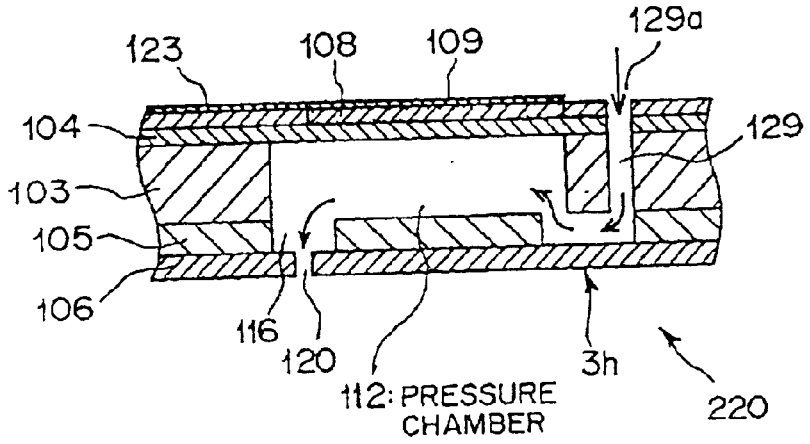

FIGS. 29(*a*) and (*b*) illustrate a configuration of an ink jet head as a third embodiment of the present invention, and wherein (a) is a plan view showing, in an enlarged scale, essential part of wiring line patterns of the ink jet head and (b) is a sectional view taken along line A—A of FIG. 29(*a*).

It is to be noted that, in FIG. 29, like reference characters to those appearing as above denote like or substantially like elements, and therefore, detailed description of them is omitted.

Also in the ink jet head 220 as the third embodiment of the present invention, ink supplying paths 129 are formed at a position different from that of the ink jet head 210 of the second embodiment, and detailed description of it is given below with reference to FIGS. 29(*a*) and (*b*).

As shown in FIGS. 29(*a*) and (*b*), also the ink jet head 220 of the present third embodiment has a plurality of nozzles 120 for discharging ink supplied thereto from an ink tank (ink supplying part) not shown similarly to the ink jet head 210 of the second embodiment described hereinabove, and includes a head body member 3*h*.

In each pressure chamber 112, on one of faces thereof which is not formed by a diaphragm 104 and is opposed to the face formed by the diaphragm 104, one end side (hereinafter referred to as opening 129*b*) of the ink supplying path 129 is open. Meanwhile, the other end side (opening 129*a*) of the ink supplying path 129 is open to the ink staying space 130 on the outer face of the head body member 3*h*.

It is to be noted that also the ink jet head 220 of the present third embodiment is formed by lamination of a plurality of layers such as dry film resist 103 and a stainless steel plate 105 similarly to the ink jet head 100 described hereinabove. The head body member 3*h* includes a single layer of dry film resist 103. The pressure chambers 112 are formed by partly removing the dry film resist layer 103.

Further, the dry film resist layer 103, stainless steel plate 105, diaphragm 104 and polyimide layer 126 are partly removed to form the ink supplying paths 129.

In other words, in the present third embodiment, each of the ink supplying paths 129 is formed such that it is open on a face of a pressure chamber 112 which is opposed to the face formed from the diaphragm 104.

Wiring line patterns 123 are formed by patterning together with the individual electrodes 109 and contact elements (not shown) on the head body member 3*h* as shown in FIG. 29(*a*). Consequently, the wiring line patterns 123 are formed as a thin film from the same material on the same plane as and integrally with the individual electrodes 109 and the contact elements.

With the configuration described above, if an ink tank (not shown) is joined directly (or through an ink tank securing member) to a framework member not shown and ink is supplied from the ink supply port of the ink tank into the ink staying space 130, then the ink temporarily resides in the ink staying space 130. Thereafter, the ink is supplied from the ink staying space 130 into the pressure chambers 112 through the ink supplying paths 129.

Then, if driving signals are supplied through the FPC to the individual electrodes 109 from a drive circuit or the like not shown after the FPC is electrically connected to the contact elements by such a system as the TAB, then the pressure chambers 112 are pressurized by the pressurization elements 140 to jet the ink from the nozzles 120.

In this instance, since the ink supplying paths 129 are formed such that they are open on the face which is opposed to the face formed by the diaphragm 104, even if the piezoelectric elements 108 or the diaphragm 104 is deformed, the ink supplying paths 129 do not have an influence of deformation of the piezoelectric elements or the diaphragm 104 and the rigidity of the pressure chambers 112 can be maintained and besides the pressurization operation is stabilized.

In this manner, with the ink jet head as the third embodiment of the present invention, similar operation and effects to those of the second embodiment described hereinabove can be achieved. Further, since the head body member 3*h* may be formed including at least one layer of dry film resist 103, the process of production can be simplified.

(J) Description of the Fourth Embodiment

Figure 30A:
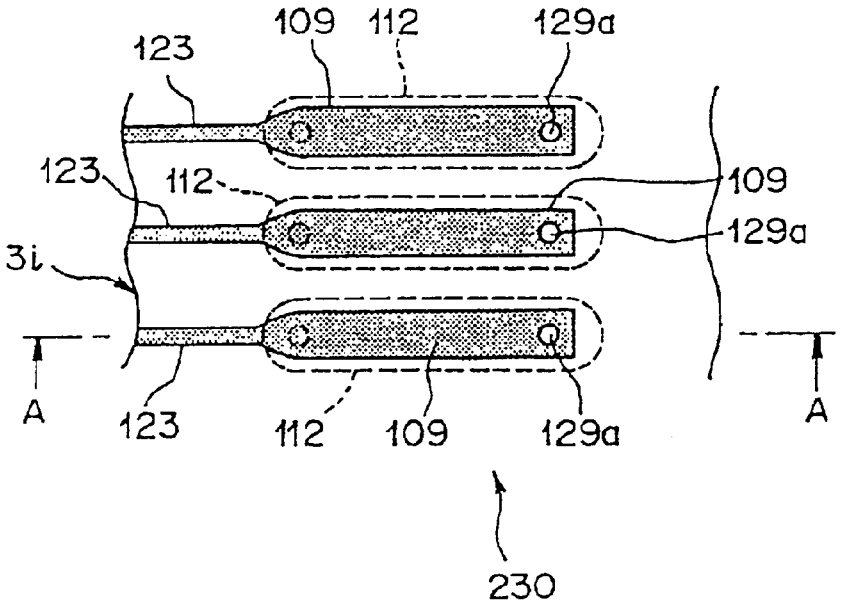
FIG. 30(*a*) is a plan view showing, in an enlarged scale, essential part of wiring line patterns of an ink jet head as a fourth embodiment of the present invention.
Figure 30B:
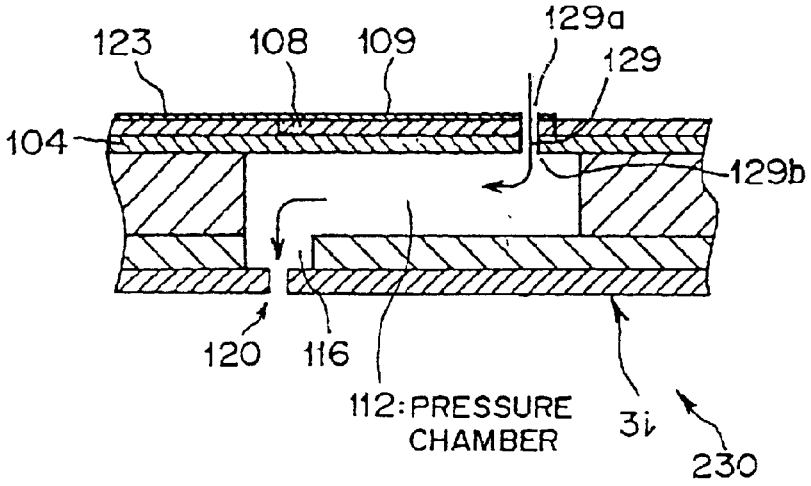

FIGS. 30(*a*) and (*b*) illustrate a configuration of an ink jet head as a fourth embodiment of the present invention, and wherein (a) is a plan view showing, in an enlarged scale, essential part of wiring line patterns of the ink jet head and (b) is a sectional view taken along line A—A of FIG. 30(*a*).

It is to be noted that, in FIG. 30, like reference characters to those appearing as above denote like or substantially like elements, and therefore, detailed description of them is omitted.

Also in the ink jet head 230 as the fourth embodiment of the present invention, ink supplying paths 129 are formed at a position different from that of the ink jet head 210 of the second embodiment, and detailed description of it is given below with reference to FIGS. 30(*a*) and (*b*).

As shown in FIGS. 30(*a*) and (*b*), also the ink jet head 230 of the present fourth embodiment has a plurality of nozzles 120 for discharging ink supplied thereto from an ink tank (ink supplying part) not shown similarly to the ink jet head 210 of the second embodiment described hereinabove, and includes a head body member 3*i*.

In each pressure chamber 112, on a face thereof which is formed by the diaphragm 104, an ink supplying path 129 is formed such that it extends through a piezoelectric element 108 and the diaphragm 104 in a lamination region of the piezoelectric element 108 and the diaphragm 104.

It is to be noted that also the ink jet head 230 of the present fourth embodiment is formed by lamination of a plurality of layers such as dry film resist 103 and a stainless steel plate 105 similarly to the ink jet head 100 described hereinabove. The head body member 3*i* includes a single layer of dry film resist 103. The pressure chambers 112 are formed by partly removing the dry film resist layer 103.

Further, the ink supplying paths 109 are formed on the face formed by the diaphragm 104 by partly removing the piezoelectric elements 108 and the diaphragm 104 in the lamination regions of the piezoelectric elements 108 and the diaphragm 104.

Wiring line patterns 123 are formed by patterning together with the individual electrodes 109 and contact elements (not shown) on the head body member 3*i* as shown in FIG. 30(*a*). Consequently, the wiring line patterns 123 are formed as a thin film from the same material on the same plane as and integrally with the individual electrodes 109 and the contact elements.

With the configuration described above, if an ink tank (not shown) is joined directly (or through an ink tank securing member) to a framework member not shown and ink is supplied from the ink supply port of the ink tank into the ink staying space 130, then the ink temporarily resides in the ink staying space 130. Thereafter, the ink is supplied from the ink staying space 130 into the pressure chambers 112 through the ink supplying paths 129.

Then, if driving signals are supplied through the FPC to the individual electrodes 109 from a drive circuit or the like not shown after the FPC is electrically connected to the contact elements by such a system as the TAB, then the pressure chambers 112 are pressurized by the pressurization elements 140 to jet the ink from the nozzles 120.

In this manner, with the ink jet head 230 as the fourth embodiment of the present invention, similar operation and effects to those of the second embodiment described hereinabove can be achieved. Further, each of the ink supplying paths 129 is formed such that it extends through the piezoelectric element 108 and the diaphragm 104 in the lamination region of the piezoelectric element 108, there is no necessity for provision of a space for exclusive use for the openings 129*a* of the ink supplying path 129 on the head body member 3*i*. Consequently, there is an advantage that not only the ink jet head can be miniaturized but also the degree of integration can be improved.

(K) Description of the Fifth Embodiment

Figure 31:
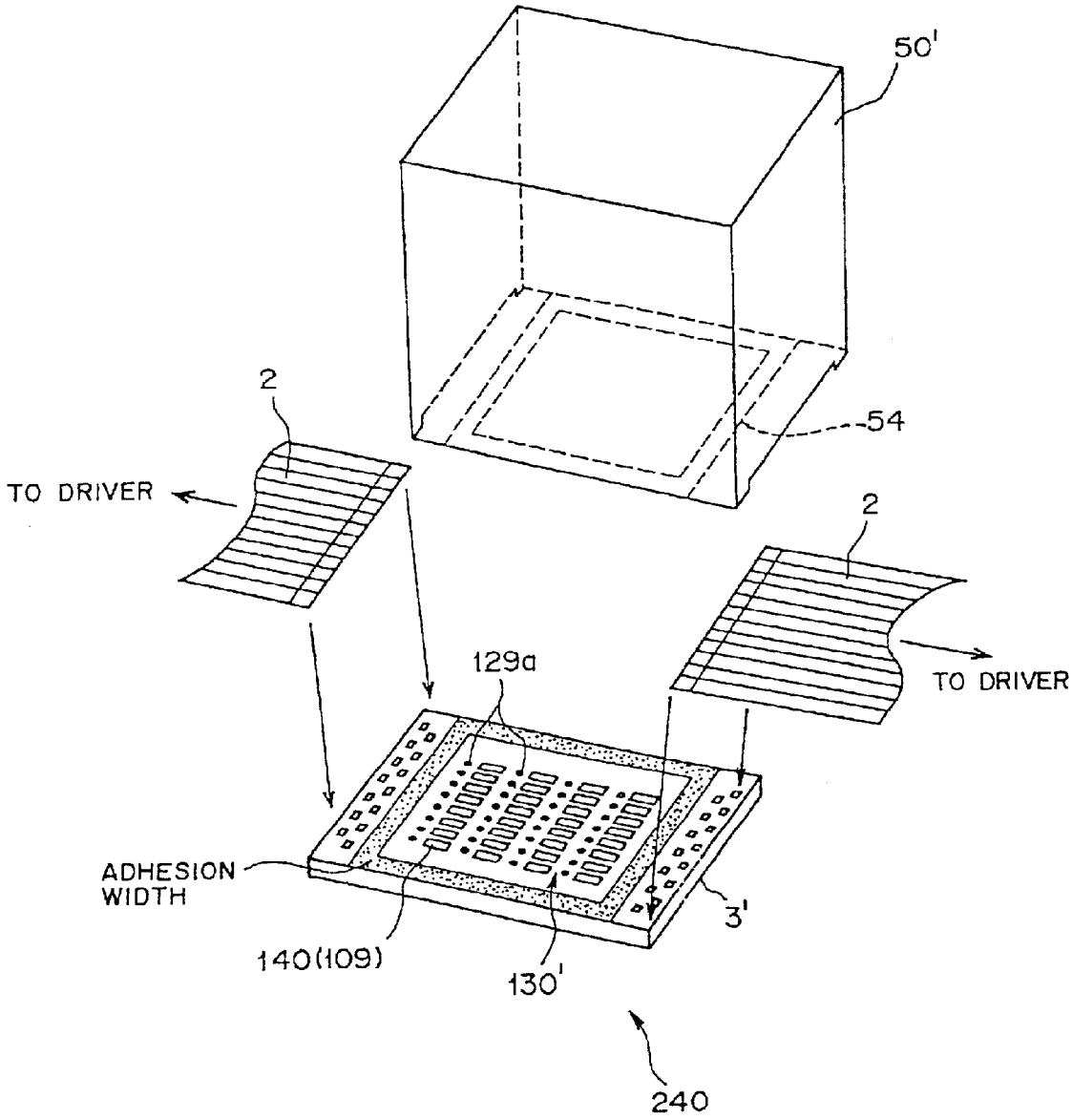
FIG. 31 is an exploded perspective view showing a general configuration of an ink jet head as a fifth embodiment of the present invention.
Figure 32:
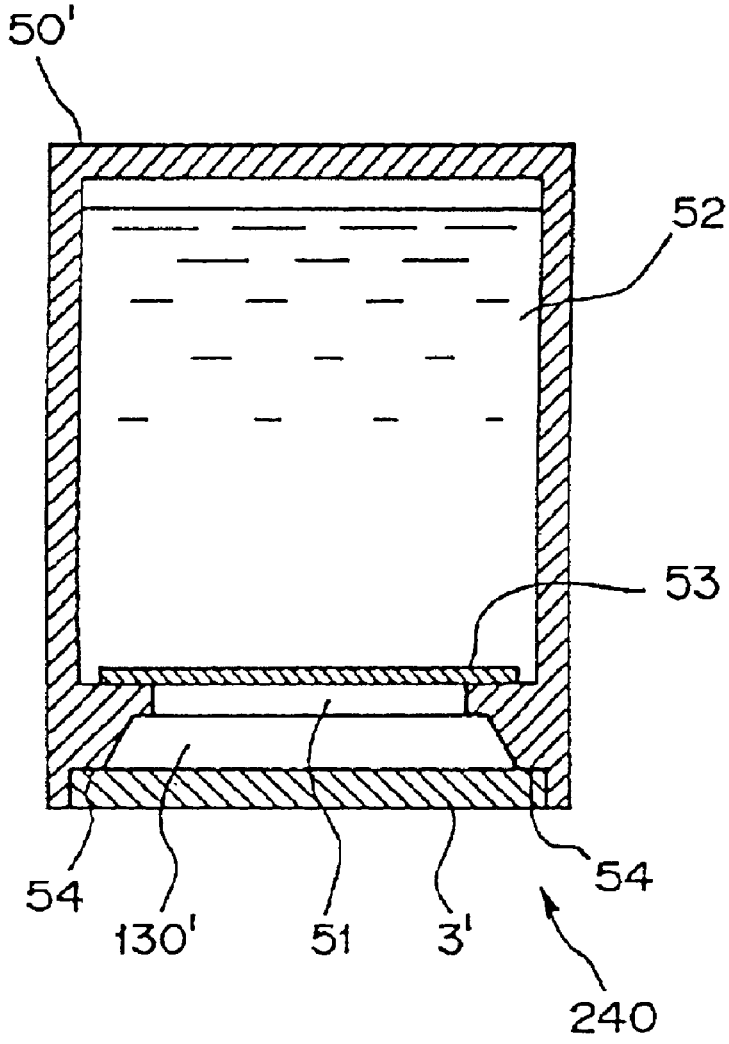
FIG. 32 is a vertical sectional view showing the ink jet head as the fifth embodiment of the present invention to which an ink tank is joined.
Figure 33:
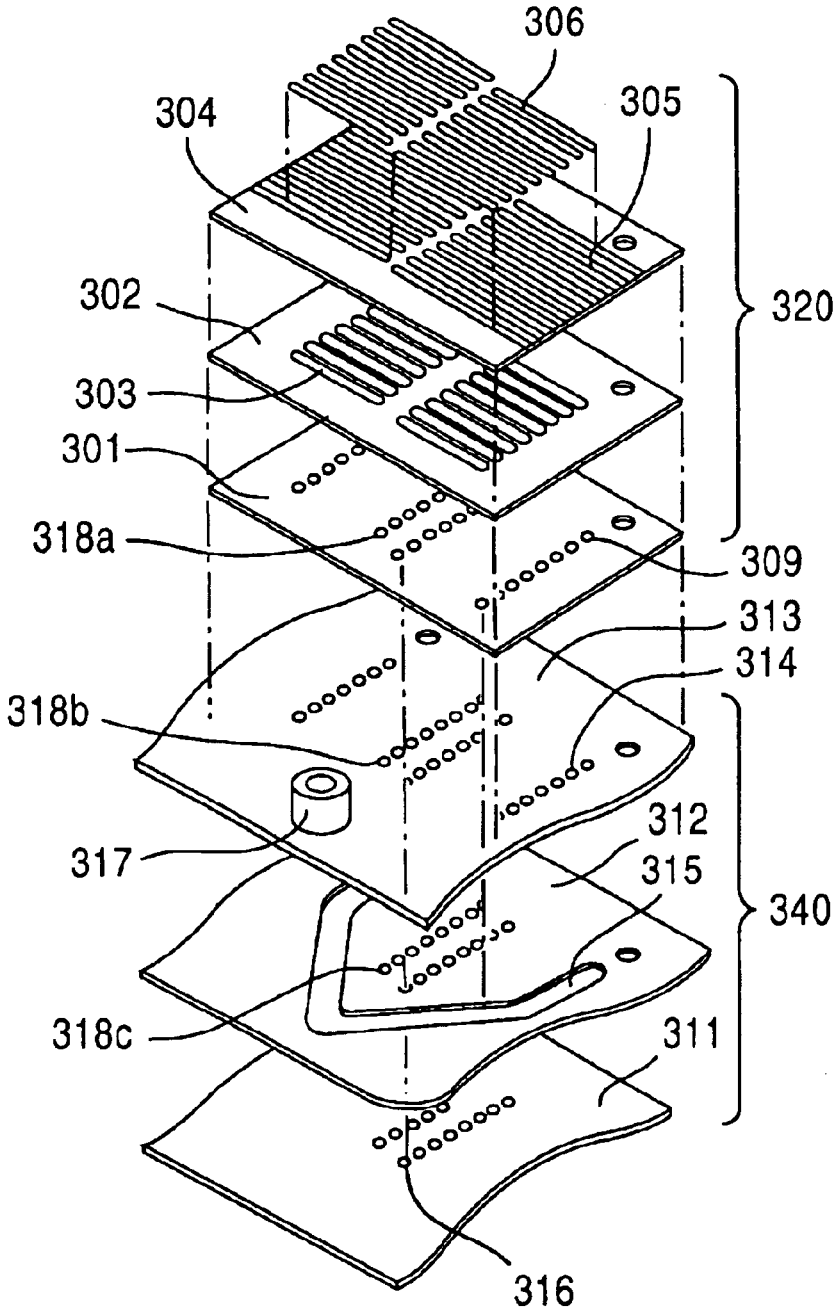
FIG.33 PRIOR ART
FIG. 33 is an exploded perspective view showing a configuration of essential part of a conventional ink jet head.
Figure 34:
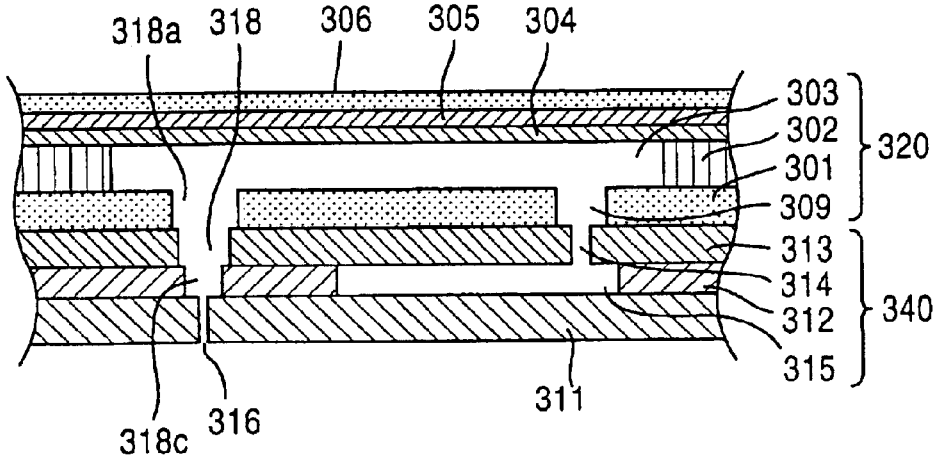
FIG.34 PRIOR ART
FIG. 34 is a vertical sectional view showing a configuration of essential part of the conventional ink jet head.

FIGS. 31 and 32 illustrate a configuration of an ink jet head as a fifth embodiment of the present invention, and wherein FIG. 31 is an exploded perspective view showing a general configuration of the ink jet head as the fifth embodiment of the present invention and FIG. 32 is a vertical sectional view showing the ink jet head as the fifth embodiment of the present invention to which an ink tank is joined.

It is to be noted that, in FIGS. 31 and 32, like reference characters to those appearing as above denote like or substantially like elements, and therefore, detailed description of them is omitted.

The ink jet head 240 as the fifth embodiment of the present invention includes a head body member 3' in place of the head body member 3 of the ink jet head 100 of the first embodiment and includes an ink tank 50' in place of the ink tank 50. In the following, detailed description of the ink jet head 240 is described with reference to FIGS. 31 and 32.

Also the ink jet head 240 of the present fifth embodiment has a plurality of nozzles (not shown) for discharging ink supplied thereto from the ink tank (ink supplying part) 50' similarly to the ink jet head 100 of the first embodiment described hereinabove, and includes a head body member 3'.

The head body member 3' includes a pressure chamber and a pressurization element 140 for each of the plurality of nozzles in the inside thereof.

It is to be noted that also the head body member 3' of the ink jet head 240 of the present fifth embodiment is formed by laminating a plurality of layers such as a dry film resist layer, a diaphragm, a stainless steel plate, a polyimide layer, individual electrodes 109 and a nozzle plate. Similarly to the head body member 3 of the ink jet head 100 of the first embodiment, the process of production by lamination is omitted.

The head body member 3' has a substantially similar configuration to that of the head body member 3 of the ink jet head 100 of the first embodiment except that it does not include the framework member 8, and includes a pressure chamber (not shown) and a pressurization element 140 provided in the inside thereof for each of a plurality of nozzles 120.

On a face of the head body member 3' on which the pressurization elements 140 are formed, that is, on the outer face which faces an ink staying space 130' (hereinafter described), one end side (hereinafter referred to as opening 129*a*) of each of the ink supplying paths 129 is open. Meanwhile, the other end sides of the ink supplying paths 129 are open to the individual pressure chambers.

Also the ink tank 50' is an ink supplying part for supplying ink to the nozzles of the head body member 3' while keeping a suitable negative pressure similarly to the ink tank 50 of the ink jet head 100 of the first embodiment, and includes an ink chamber 52, a filter 53 and an ink supply port 51 as well as a joining element 54 as shown in FIG. 32.

After a bonding agent or the like is applied to the joining element 54 of the ink tank 50', the ink tank 50' is joined to the head body member 3'. In this instance, the joining element 54 surrounds the openings 129*a* of the plurality of ink supplying paths 129 on the outer face of the head body member 3', and an ink staying space 130' is formed by a lower face of the ink tank 50' and upper faces of the joining element 54 and the head body member 3'.

It is to be noted that also the ink jet head 240 of the present fifth embodiment is formed by lamination of a plurality of layers such as dry film resist 103 and a stainless steel plate 105 similarly to the ink jet head 100 described hereinabove, and detailed description thereof is omitted.

With the configuration described above, if the ink tank 50' is joined directly to a framework member not shown and ink is supplied from the ink supply port 51 of the ink tank 50' into the ink staying space 130', then the ink temporarily resides in the ink staying space 130'. Thereafter, the ink is supplied from the ink staying space 130' into the pressure chambers 112 through the ink supplying paths 129.

Then, if driving signals are supplied through the FPC to the individual electrodes 109 from a drive circuit or the like not shown after the FPC is electrically connected to the contact elements by such a system as the TAB, then the pressure chambers 112 are pressurized by the pressurization elements 140 to jet the ink from the nozzles 120.

In this manner, also with the ink jet head 240 as the fifth embodiment of the present invention, since there is no necessity to provide ink supplying ports for exclusive use in the head body member 3' similarly to the ink jet head 100 of the first embodiment, the ink jet head 240 can be miniaturized and besides the degree of integration can be improved. Further, supply of ink to the pressure chambers 112 can be made uniform, and the printing quality can be improved.

Further, when the ink tank 50' or an ink tank securing member is joined to the head body member 3', the adhesion width can be reduced. Consequently, the head body member 3' can be formed in a reduced size, and the ink jet head 240 and hence the printing apparatus (ink jet printer) can be miniaturized.

(L) Others

It is to be noted that the present invention is not limited to the embodiments described hereinabove but can be carried out in various modified forms without departing from the spirit and scope of the present invention.

For example, while the ink jet head 100 of the first embodiment described hereinabove is formed by joining two layers of the (A) layer and the (B) layer to each other, the ink jet head is not limited to this, and a desired number of such (B) layers may be provided and also the thickness of each layer may be a desired thickness.

Further, a member made of a material other than a metal material or a ceramic material such as, for example, a resin material such as PEN or a composite resin material such as FRP may be disposed in place of the stainless steel plate 105. It is to be noted that, where any of such members as just mentioned is used, since it has a coefficient of thermal expansion similar to that of the dry film resist 103, the thermal residual stress by heating processing upon joining or the like can be reduced, and the quality of the ink jet head can be improved.

Furthermore, while the contact elements 121 and 127 and the FPC 2 (2*a*) are connected to each other by the TAB system, the connection is not limited to this and can be carried out in various modified forms.

Further, in the embodiments and modifications described above, the shape of the framework member 8 (8*a* to 8*c*) is not limited to them and can be carried out in various modified forms.

Furthermore, in the embodiments and modifications described above, the shape of the wiring line patterns 123 is not limited to them, and, for example, the wiring line patterns 123 may have a shape of the wiring line patterns 123*a* (123*b*) as shown in the second modification or the third modification to the first embodiment.

It is to be noted that, where the embodiments of the present invention are disclosed, they can be produced by those skilled in the art.

Industrial Applicability of the Invention

As described above, with an ink jet head and a printing apparatus of the present invention, since ink from an ink supplying part can be supplied directly into pressure chambers, an ink supplying opening for exclusive use is not required for a head body member, and there is an advantage that the ink jet head can be miniaturized and the degree of integration can be improved and besides supply of the ink into the pressure chambers can be made uniform and the printing quality can be improved. Consequently, the ink jet head and the printing apparatus are suitable particularly for a printing apparatus which includes an ink jet head.

What is claimed is:

1. An ink jet head having a plurality of nozzles for discharging ink supplied thereto from an ink supplying part, characterized in that comprising;

a head body member including a plurality of pressure chambers provided one for each of said nozzles for being filled with the ink and a plurality of pressurization elements provided one for each of said pressure chambers for pressurizing said pressure chambers to discharge the ink in said pressure chambers from said nozzles, that an ink staying space for temporarily staying the ink from said ink supplying part therein is formed between said head body member and said ink supplying part, and that a plurality of ink supplying paths for communicating said ink staying space and said plurality of pressure chambers individually with each other are formed in said head body member such that one end side of each of said ink supplying paths is open to said ink staying space on an outer face of said head body member and the other end side of each of said ink supplying paths is open to a corresponding one of said pressure chambers, a framework member is provided in a projecting manner on said head body member in such a manner as to surround openings of said plurality of ink supplying paths on the outer face of said head body member, said ink staying space is formed by said framework member, head body member and ink supplying part, and said head body member is formed on a substrate, and said framework member is formed as a remaining portion of said substrate on said head body member by partially removing said substrate from said head body member.

2. An ink jet head as set forth in claim 1, characterized in that said framework member is used as a joining element for joining said ink supplying part to said head body member.

3. An ink jet head as set forth in any one of claims 1 and 2, characterized in that each of said pressurization elements includes a diaphragm which forms one face of a corresponding one of said pressure chambers and partitions the pressure chamber and said ink staying space from each other, and a piezoelectric element formed by lamination on said diaphragm on the outside of the pressure chamber for driving said diaphragm to pressurize the pressure chamber.

4. An ink jet head having a plurality of nozzles for discharging ink supplied thereto from an ink supplying part, characterized in that comprising;

a head body member including a plurality of pressure chambers provided one for each of said nozzles for being filled with the ink and a plurality of pressurization elements provided one for each of said pressure chambers for pressurizing said pressure chambers to discharge the ink in said pressure chambers from said nozzles, that an ink staying space for temporarily staying the ink from said ink supplying part therein is formed between said head body member and said ink supplying part, and that a plurality of ink supplying paths for communicating said ink staying space and said plurality of pressure chambers individually with each other are formed in said head body member such that one end side of each of said ink supplying paths is open to said ink staying space on an outer face of said head body member and the other end side of each of said ink supplying paths is open to a corresponding one of said pressure chambers, wherein each of said pressurization elements includes a diaphragm which forms one face of a corresponding one of said pressure chambers and partitions the pressure chamber and said ink staying space from each other, and a piezoelectric element formed by lamination on said diaphragm on the outside of the pressure chamber for driving said diaphragm to pressurize the pressure chamber.

5. An ink jet head having a plurality of nozzles for discharging ink supplied thereto from an ink supplying part, characterized in that comprising;

a head body member including a plurality of pressure chambers provided one for each of said nozzles for being filled with the ink and a plurality of pressurization elements provided one for each of said pressure chambers for pressurizing said pressure chambers to discharge the ink in said pressure chambers from said nozzles, that an ink staying space for temporarily staying the ink from said ink supplying part therein is formed between said head body member and said ink supplying part, and that a plurality of ink supplying paths for communicating said ink staying space and said plurality of pressure chambers individually with each other are formed in said head body member such that one end side of each of said ink supplying paths is open to said ink staying space on an outer face of said head body member and the other end side of each of said ink supplying paths is open to a corresponding one of said pressure chambers, a framework member is provided in a projecting manner on said head body member in such a manner as to surround openings of said plurality of ink supplying paths on the outer face of said head body member, wherein said ink staying space is formed by said framework member, head body member and in supplying part, and each of said pressurization elements includes a diaphragm which forms one face of a corresponding one of said pressure chambers and partitions the pressure chamber and said ink staying space from each other, and a piezoelectric element formed by lamination on said diaphragm on the outside of the pressure chamber for driving said diaphragm to pressurize the pressure chamber.

6. An ink jet head as set forth in any one of claims 1, 4 and 5, characterized in that each of said ink supplying paths extends through said diaphragm in a region other than a region in which a corresponding one of the piezoelectric elements is laminated.

7. An ink jet head as set forth in any one of claims 1, 4 and 5, characterized in that each of said ink supplying paths extends through said piezoelectric elements and said diaphragm in a region in which a corresponding one of the piezoelectric elements is laminated.

8. An ink jet head as set forth in any one of claims 1, 4 and 5, characterized in that each of said ink supplying paths is formed so as to open on a face of a corresponding one of the pressure chambers other than the face formed by said diaphragm.

9. An ink jet head as set forth in claim 8, characterized in that each of said ink supplying paths is formed so as to open on a face of a corresponding one of the pressure chambers opposing to the face formed by said diaphragm.

10. A printing apparatus which includes an ink jet head having a plurality of nozzles for discharging ink supplied thereto from an ink supplying part characterized in that said ink jet head comprising;

a head body member including a plurality of pressure chambers provided one for each of said nozzles for being filled with the ink and a plurality of pressurization elements provided one for each of said pressure chambers for pressurizing said pressure chambers to discharge the ink in said pressure chambers from said nozzles, that an ink staying space for temporarily staying the ink from said ink supplying part therein is formed between said head body member and said ink supplying part, and that a plurality of ink supplying paths for communicating said ink staying space and said plurality of pressure chambers individually with each other are formed in said head body member such that one end side of each of said ink supplying paths is open to said ink staying space on an outer face of said head body member and the other end side of each of said ink supplying paths is open to a corresponding one of said pressure chambers, a framework member is provided in a projecting manner on said head body member in such a manner as to surround openings of said plurality of ink supplying paths on the outer face of said head body member, said ink staying space is formed by said framework member, head body member and ink supplying part, and said head body member is formed on a substrate, and said framework member is formed as remaining portion of said substrate on said head body member by partially removing said substrate from said head body member.

11. A printing apparatus as set forth in claim 10, characterized in that said framework member is used as a joining element for joining said ink supplying part to said head body member.

12. A printing apparatus as set forth in any one of claims 10 and 11, characterized in that each of said pressurization elements includes a diaphragm which forms one face of a corresponding one of said pressure chambers and partitions the pressure chamber and said ink staying space from each other, and a piezoelectric element formed by lamination on said diaphragm on the outside of the pressure chamber for driving said diaphragm to pressurize the pressure chamber.

13. A printing apparatus which includes an ink jet head having a plurality of nozzles for discharging ink supplied thereto from an ink supplying part, characterized in that said ink jet head comprising;

a head body member including a plurality of pressure chambers provided one for each of said nozzles for being filled with the ink and a plurality of pressurization elements provided one for each of said pressure chambers for pressurizing said pressure chambers to discharge the ink in said pressure chambers from said nozzles, that an ink staying space for temporarily staying the ink from said ink supplying part therein is formed between said head body member and said ink supplying part, and that a plurality of ink supplying paths for communicating said ink staying space and said plurality of pressure chambers individually with each other are formed in said head body member such that one end side of each of said ink supplying paths is open to said ink staying space on an outer face of said head body member and the other end side of each of said ink supplying paths is open to a corresponding one of said pressure chambers, wherein each of said pressurization elements includes a diaphragm which forms one face of a corresponding one of said pressure chambers and partitions the pressure chamber and said ink staying space from each other, and a piezoelectric element formed by lamination on said diaphragm on the outside of the pressure chamber for driving said diaphragm to pressurize the pressure chamber.

14. A printing apparatus which includes an ink jet head having a plurality of nozzles for discharging ink supplied thereto from an ink supplying part, characterized in that said ink jet head comprising;

a head body member including a plurality of pressure chambers provided one for each of said nozzles for being filled with the ink and a plurality of pressurization elements provided one for each of said pressure chambers for pressurizing said pressure chambers to discharge the ink in said pressure chambers from said nozzles, that an ink staying space for temporarily staying the ink from said ink supplying part therein is formed between said head body member and said ink supplying part, and that a plurality of ink supplying paths for communicating said ink staying space and said plurality of pressure chambers individually with each other are formed in said head body member such that one end side of each of said ink supplying paths is open to said ink staying space on an outer face of said head body member and the other end side of each of said ink supplying paths is open to a corresponding one of said pressure chambers, a framework member is provided in a projecting manner on said head body member in such a manner as to surround openings of said plurality of ink supplying paths on the outer face of said head body member, wherein said ink staying space is formed by said framework member, head body member and ink supplying part, and each of said pressurization elements includes a diaphragm which forms one face of a corresponding one of said pressure chambers and partitions the pressure chamber and said ink staying space from each other, and a piezoelectric element formed by lamination on said diaphragm on the outside of the pressure chamber for driving said diaphragm to pressurize the pressure chamber.

15. A printing apparatus as set forth in any one of claims 10, 13 and 14 characterized in that each of said ink supplying paths extends through said diaphragm in a region other than a region in which a corresponding one of the piezoelectric elements is laminated.

16. A printing apparatus as set forth in any one of claims 10, 13 and 14 characterized in that each of said ink supplying paths extends through said piezoelectric elements and said diaphragm in a region in which a corresponding one of the piezoelectric elements is laminated.

17. A printing apparatus as set forth in any one of claims 10, 13 and 14 characterized in that each of said ink supplying paths is formed so as to open on a face of a corresponding one of the pressure chambers other than the face formed by said diaphragm.

18. A printing apparatus as set forth in claim 17, characterized in that each of said ink supplying paths is formed so as to open on a face of a corresponding one of the pressure chambers opposing to the face formed by said diaphragm.

* * * * *